US006684659B1

(12) United States Patent
Tanaka et al.

(10) Patent No.: US 6,684,659 B1
(45) Date of Patent: Feb. 3, 2004

(54) REFRIGERATOR AND DEFROSTING HEATER

(75) Inventors: Masaaki Tanaka, Itami (JP); Takeshi Shimizu, Tondabayashi (JP); Koichi Nishimura, Higashiosaka (JP)

(73) Assignee: Matsushita Refrigeration Company, Osaka (JP)

( * ) Notice: Subject to any disclaimer, the term of this patent is extended or adjusted under 35 U.S.C. 154(b) by 0 days.

(21) Appl. No.: 09/979,047

(22) PCT Filed: May 15, 2000

(86) PCT No.: PCT/JP00/03091

§ 371 (c)(1),
(2), (4) Date: Nov. 15, 2001

(87) PCT Pub. No.: WO00/70281

PCT Pub. Date: Nov. 23, 2000

(30) Foreign Application Priority Data

May 17, 1999 (JP) ..... 11-135304

(51) Int. Cl.[7] ..... F25D 21/06

(52) U.S. Cl. ..... 62/276; 62/278; 62/196.74; 219/553; 219/542; 219/523

(58) Field of Search ..... 62/276, 196.4, 62/278; 219/553, 542, 523

(56) References Cited

U.S. PATENT DOCUMENTS

| | | | | |
|---|---|---|---|---|
| 2,719,406 A | | 10/1955 | Tobey | |
| 3,280,581 A | | 10/1966 | Turner | |
| 3,735,328 A | * | 5/1973 | Yagi | 338/270 |
| 4,210,001 A | * | 7/1980 | Miller, Sr. | 62/468 |
| 4,270,364 A | | 6/1981 | Oonishi et al. | |
| 4,522,037 A | * | 6/1985 | Ares et al. | 62/196.4 |
| 5,003,786 A | | 4/1991 | Fudono et al. | |
| 5,042,267 A | | 8/1991 | Beers et al. | |
| 5,255,536 A | | 10/1993 | Jung et al. | |
| 5,291,742 A | | 3/1994 | Kawatani et al. | |
| 5,545,878 A | * | 8/1996 | Jasper, II et al. | 219/541 |
| 5,694,779 A | | 12/1997 | Matsushima et al. | |
| 6,105,379 A | * | 8/2000 | Alsenz et al. | 62/225 |
| 6,318,107 B1 | * | 11/2001 | Pandaru et al. | 62/277 |

FOREIGN PATENT DOCUMENTS

| | | |
|---|---|---|
| EP | 0165220 | 12/1985 |
| GB | 2277663 | 11/1994 |
| JP | 57-66470 | 4/1982 |
| JP | 62-40793 | 3/1987 |
| JP | 6-56675 | 8/1994 |
| JP | 7-22165 | 1/1995 |
| JP | 8-54172 | 2/1996 |
| JP | 9-42817 | 2/1997 |
| JP | 9-61041 | 7/1997 |
| JP | 9-329386 | 12/1997 |
| JP | 10-321345 | 12/1998 |
| JP | 11-257831 | 9/1999 |
| JP | 2000-121235 | 4/2000 |
| JP | 2000-121237 | 4/2000 |

* cited by examiner

*Primary Examiner*—William C. Doerrler
*Assistant Examiner*—Mark S. Shulman
(74) *Attorney, Agent, or Firm*—Wenderoth, Lind & Ponack, L.L.P.

(57) ABSTRACT

In a refrigerator using a flammable coolant, in order to decrease danger of ignition when defrosting is conducted under an environment of leakage of the flammable coolant, the refrigerator comprises a cooling cycle evaporator and a defrosting devicve for defrosting the evaporator, wherein a temperature of the defrosting device is lower than an ignition temperature of the flammable coolant.

41 Claims, 12 Drawing Sheets

REFRIGERATOR AND DEFROSTING HEATER

TECHNICAL FIELD

The present invention relates to a refrigerator having a defrosting device for defrosting an evaporator with a heater.

BACKGROUND ART

In recent years, art associated with a freezing refrigerator having a defrosting device for an evaporator is disclosed in Japanese Unexamined Patent Publication No. HEI 8-54172. A schematic side sectional view showing a structure thereof is shown in FIG. 31. Hereinafter, a conventional freezing refrigerator will be explained by referring to the drawings.

In FIG. 31, reference numeral 1 denotes a refrigerator housing. Reference numeral 2 denotes a freezing chamber located inside the refrigerator housing 1. Reference numeral 3 denotes a refrigerator chamber located inside the refrigerator housing 1. Reference numeral 4 denotes a door of the freezing chamber. Reference numeral 5 denotes a door of the refrigerator chamber. Reference numeral 6 denotes a partition wall for partitioning the freezing chamber 2 and the refrigerator chamber 3 from each other. Reference numeral 7 denotes an inlet port of the freezing chamber 2 for sucking air into the freezing chamber. Reference numeral 8 denotes an inlet port of the refrigerator chamber 3 for sucking air into the refrigerator chamber. Reference numeral 9 denotes a discharge port for discharging cool air. Reference numeral 10 denotes an evaporator. Reference numeral 11 denotes a fan for circulating cool air.

Reference numeral 12 denotes a partition wall of the evaporator 10 for partitioning the evaporator and the freezing chamber 2. Reference numeral 13 denotes a basin. Reference numeral 14 denotes a drain outlet. Reference numeral 15 denotes a defrosting tube heater in which a Nichrome wire held in a coil-like configuration is covered with a glass tube. Reference numeral 16 denotes a roof for preventing an evaporation sound, generated when a defrost water is directly dripped on the defrosting tube heater 15. Reference numeral 17 denotes a metal-made bottom surface plate mounted between the basin 13 and the defrosting tube heater 15 to be insulated and held.

In this conventional refrigerator, when the freezing chamber 2 and the refrigerator chamber 3 are cooled, coolant is allowed to flow through the evaporator 10 so that the evaporator 10 is cooled. In the same manner, with operation of the fan 11, air having an increased temperature in the freezing chamber 2 and the refrigerator chamber 3 is sent to a cooling chamber, and this air is cooled via heat exchange in the evaporator 10. Then, the cooled air is sent to an interior of the freezing chamber 2 from the discharge port 9 so that cold air is sent to the refrigerator chamber 3 through a communication port (not shown) from the freezing chamber 2.

Generally, air which has undergone heat exchange within the evaporator 10 is highly humidified with an inflow of high temperature outside air as a result of frequent opening and closing of door 4 and door 5, and evaporation of moisture content of conserved food in the freezing chamber 2 and the refrigerator chamber 3, or the like, so that moisture in the air becomes frosted and adheres to the evaporator 10, which has a temperature lower than the air. With an increase in frost quantity, heat transmission with air undergoing heat exchange with a surface of the evaporator 10 is hindered, while a heat passage ratio is lowered because of lowering of conveyed air quantity resulting from ventilation resistance, with a result that a cooling shortage is generated.

Therefore, before a frost quantity becomes superfluous, the Nichrome wire of the defrosting tube heater 15 is electrified. When electrification of the Nichrome wire is started, heat is radiated to the evaporator 10 and peripheral parts from the Nichrome wire. At this time, heat radiated to the bottom plate 17 is partially reflected according to a form of the bottom plate 17, while remaining heat is reflected toward the evaporator 10 and the peripheral parts. As a consequence, frost which adheres to and near the evaporator 10, the basin 13 and the exhaust port 14 is melted into water. Additionally, in this manner, a portion of defrosted water which is melted in this manner is directly dripped on the basin 13 while a remaining portion makes a detour of the defrosting tube heater 15 to fall to the basin 13 by way of the roof 16, to be exhausted to an exterior from the drain outlet 14.

However, with the above structure, when the defrosting tube heater 15 is generally electrified, not only a surface temperature of the Nichrome wire, but also a surface temperature of the glass surrounding the wire, come to have a high temperature. At the same time, since the bottom plate 17 is located in the vicinity of the tube heater 15, part of heat radiated from the tube heater 15 is reflected again to the tube heater 15 with a result that a heated temperature of the tube heater 15 unusually rises and attains a value not lower than an ignition temperature of a flammable coolant to be used. Accordingly, there is a problem in that in a case where the flammable coolant is used as a coolant, leakage of the flammable coolant from piping mounted on a portion communicating with the evaporator 10 and inside of the refrigerator leads to danger of ignition of the flammable coolant with electrification of the defrosting heater 15, so as to result in an explosion.

SUMMARY OF THE INVENTION

In view of the above problem, an object of the present invention is to provide a freezing refrigerator which can suppress danger of ignition of a flammable coolant even in a case where defrosting is conducted in an environment in which the flammable coolant is leaked to an atmosphere of a defrosting device.

In order to attain the above object, the refrigerator according to the present invention comprises a freezing cycle for connecting a compressor, a condenser, a depression mechanism and a vaporizer to seal flammable coolant, and a defrosting heater or device for defrosting the vaporizer, wherein a heated temperature of the defrosting heater during operation becomes only lower than an ignition temperature of the flammable coolant. Consequently, when the flammable coolant is leaked to an inside of the refrigerator because of breakage of piping or the like, danger of ignition is extremely lowered even when heating of the defrosting heater or device is started.

As the defrosting device, it is desirable to mount a glass tube and a heater wire formed of metal resistor inside of the glass tube. In such a case, it is desirable to heat the heater wire up to a temperature lower than the ignition temperature of the flammable coolant. Since a majority of heat resulting from the heater wire, which is a heating body, is radiated to frost which has adhered to the evaporator and peripheral parts, defrosting is conducted during a defrosting time which is the same as, or less than conventional defrosting time, while corrosion and deterioration or the like resulting from direct contact with exterior air can be prevented.

Consequently, while a defrosting capability and life of the defrosting device that is the same as, or more than, conventional defrosting capability and life can be secured, a surface temperature of the heater wire which is likely to come into contact with exterior air can be set to a level that is the same as, or lower than, the ignition temperature of the flammable coolant.

It is desirable that a surface at a central portion of a length of a spiral portion of the heater wire has a heated temperature lower than the ignition temperature of the flammable coolant. By doing so, it is possible to set a surface temperature of the heater wire at the central portion, which has a high temperature, to a temperature that is the same as or lower than the ignition temperature of the flammable coolant in a length direction of the spiral portion, while securing a defrosting capability and life to be the same as, or more than, conventional defrosting capability and life. Consequently, a temperature of the heater wire in its entirety can be set to lower than the ignition temperature of the flammable coolant.

As another method, it is desirable to heat a heaterwire so that a surface temperature of a spiral portion thereof is set to a temperature lower than an ignition temperature of a flammable coolant to be used. By so doing, while securing a defrosting capability and life to be the same as, or more than, conventional defrosting capability and life, it is possible to set, to a temperature lower than the ignition temperature of the flammable coolant, a heated temperature at an upper portion of the heater wire which comes to have a higher temperature above and below the spiral portion because of movement of high temperature gas resulting from heating of the heater wire. Consequently, it is possible to allow the heater wire in its entirety to have a temperature lower than the ignition temperature of the flammable coolant.

Preferably, the above heater wire comprises a straight portion formed in a straight configuration at both ends thereof, and a spiral portion formed in a spiral configuration at another portion between both ends. It is desirable that a heating value per unit area becomes lower than 2.5 W/cm$^2$, which quantity is obtained by dividing a heating value resulting from Joule heat of the spiral portion by a surface area thereof. Consequently, it is possible to secure a defrosting capability and life to be the same as, or more than, conventional defrosting capability and life. Furthermore, the heater wire comes to have a temperature lower than the ignition temperature of the flammable coolant by setting to lower than 2.5 W/cm$^2$ the heating value per unit area of the spiral portion which comes to have a higher temperature under influence from mutually adjacent portions of the heater wire, as compared with the straight portions of the heater wire.

Furthermore, when an entire heating value of the heater wire is increased, a surface temperature of the heater wire rises. However when the heater wire is designed in such a manner than the heating value per unit area is lower than 2.5 W/cm$^2$, even when the entire heating value is increased, a temperature of the heater wire can be lower than the ignition temperature of the flammable coolant irrespective of the heating value of the heater wire in its entirety.

Accordingly, design of a defrosting device can be easy, which enables setting a temperature of a heater wire to a value lower than an ignition temperature of a flammable coolant to be used, while maintaining a temperature of the heater wire lower than the ignition temperature of the flammable coolant.

Furthermore, the heater wire may have a value of lower than 8.5 W/cm$^3$, which value is obtained by dividing a heating value of the spiral portion by a volume surrounded by an outer diameter and length of the spiral portion. In this case as well, a defrosting capability and life that are the same as, or more than, conventional defrosting capability and life can be secured while a temperature of the heater wire can be increased while maintaining this temperature to be lower than an ignition temperature of a flammable coolant to be used.

Furthermore, in a case where the outer diameter of the spiral portion changes, a temperature of the heater wire becomes lower than an ignition temperature of a flammable coolant to be used without affecting the outer diameter of the spiral portion of the heater wire when the spiral portion is designed so that a heating value with respect to volume calculated from the outer diameter and length of the spiral portion becomes lower than 8.5 W/cm$^2$.

As another method, it is desirable to set to lower than 9.2 W/cm$^2$ a value obtained by dividing a heating value of the spiral portion of the heater wire by a surface area thereof. As a consequence, it is possible to secure a defrosting capability and life to be the same as, or more than, conventional defrosting capability and life while an entire heating value of the heater wire can be increased while maintaining a temperature of the heaterwireto be lower than an ignition temperature of a flammable coolant to be used.

Furthermore, in a case where pitch and outer diameter of the spiral portion has changed as well, a temperature of the flammable coolant becomes lower than the ignition temperature of the flammable coolant without affecting the change in the pitch and outer diameter of the spiral portion by designing the spiral portion in such a manner that a value becomes lower than 9.2 W/cm$^2$, which value is obtained by subtracting a heating value per unit area of the spiral portion from a coefficient obtained by dividing the pitch of the spiral portion by the outer diameter of the spiral portion.

Furthermore, when pitch of the spiral portion of the heater wire is 2 mm or more, influence on the heater wire from mutually adjacent portions of the spiral portion of the heater wire can be decreased. Accordingly, since temperature unevenness resulting from unevenness of pitch of the spiral portion can be decreased, a temperature of the heater wire in its entirety becomes lower than an ignition temperature of a flammable coolant to be used.

Additionally, when the heater wire is partially formed of a metal which is melted and disconnected at a temperature lower than an ignition temperature of a flammable coolant to be used, a temperature of the heater wire is transmitted to metal of a temperature fuse when a heated temperature of the heater wire comes close to the ignition temperature of the flammable coolant. As a consequence, at a predetermined temperature lower than the ignition temperature of the flammable coolant, metal of the temperature fuse is melted and disconnected so that a rise in temperature of the heater wire to, or greater than, the ignition temperature of the flammable coolant is suppressed by shielding of input.

Furthermore, according to a preferred embodiment of the present invention, a temperature fuse formed of metal which is melted and disconnected at a temperature lower than an ignition temperature of a flammable coolant to be used is connected in series to a defrosting device, and the temperature fuse is located in the vicinity of the defrosting device. Thus, when temperature of a heater wire comes close to the ignition temperature of the flammable coolant, a heated temperature of the heater wire is transmitted to the temperature fuse with a result that the metal of the temperature fuse is melted at a predetermined temperature lower than the ignition temperature of the flammable coolant, and a rise in temperature of the heater wire to a temperature not lower than the ignition temperature is suppressed with shielding of input. Furthermore, in a case where the temperature fuse is damaged under some influence, and no problem is caused in the defrosting device, only the temperature fuse is replaced. Thus, maintenance is easy.

Incidentally, the temperature fuse may be mounted in close contact with a defrosting device, or the temperature fuse may be allowed to adhere to a hull surface of an upper portion of a defrosting device. In the former example, there is provided an effect such that a surface temperature of the defrosting device is accurately transmitted to the defrosting device, and a rise in temperature of the defrosting device to a temperature not lower than an ignition temperature of a flammable coolant to be used can be suppressed while maintenance only of the temperature fuse is easy. In the latter example, there is provided an effect such that when a temperature of the upper portion of the defrosting device, which is a high temperature portion in a vertical direction, is detected the temperature fuse is melted and disconnected, and a rise in temperature of the defrosting device in its entirety to a temperature not lower than the ignition temperature of the flammable coolant can be suppressed by shielding of input at a predetermined temperature lower than the ignition temperature of the flammable coolant while maintenance is easy.

A temperature fuse formed of a metal which is wired in series with a defrosting device and which is melted and disconnected at a temperature lower than an ignition temperature of a flammable coolant to be used may be allowed to adhere to a surface of a hull of a lower portion of the defrosting device, or a surface of a hull of a central portion in a length direction of the defrosting device. In the former case, there is provided an effect such that a temperature of the temperature fuse is not lowered because of a direct contact with defrost water which is dripped from an evaporator or the like located at an upper portion of the defrosting deivce, so that a heated temperature of the defrosting device can be accurately detected, and a rise in temperature to at least the ignition temperature can be more accurately suppressed while maintenance is easy. In the latter case, there is provided an effect such that when a temperature of the central portion, which is a high temperature portion, in the length direction of the defrosting device becomes a temperature lower than the ignition temperature of the flammable coolant, the temperature fuse which is mounted in close contact with the portion is melted and disconnected, and a rise in temperature of the defrosting device is further suppressed to no more than the ignition temperature with shielding of input while maintenance of only the temperature fuse is easy.

According to a preferred embodiment of the present invention, a defrosting device comprises a glass tube and a heater wire formed of a metal resistor inside of the glass tube. A temperature fuse is mounted on the glass tube in close contact therewith, so that metal which forms a constituent element of the temperature fuse is melted and disconnected at a temperature which is lowered by 100 to 200° C. from an ignition temperature of a flammable coolant to be used. Consequently, when the heater wire, which is a heating body, attains a temperature in the vicinity of the ignition temperature of the flammable coolant, and a predetermined temperature lower than the ignition temperature, a surface of the glass tube on an outer periphery of the heater wire comes to have a temperature 100 to 200° C. lower than the predetermined temperature with heat lost when transmitted from the heater wire to the glass tube. Accordingly, the temperature fuse mounted in close contact with the surface of the glass tube is melted and disconnected, and a rise in temperature to a value the same as or more than the ignition temperature of the flammable coolant with shielding of input is further suppressed while maintenance of only the temperature fuse is easy.

As another method, a heater wire comprises a straight portion formed in a straight configuration and a spiral portion formed in a spiral configuration. A temperature fuse may be formed of metal which is melted and disconnected at a temperature lower than an ignition temperature of a flammable coolant to be used, and may be mounted on a surface of a glass tube on an outer periphery of the straight portion of the heater wire. In such a case, when the heater wire comes to have a predetermined temperature lower than the flammable coolant, the temperature fuse which is mounted on the surface of the glass tube in close contact therewith is melted and disconnected, and a rise in temperature of a defrosting device to a temperature not lower than the ignition temperature of the flammable coolant is suppressed by shielding of input while maintenance only of the temperature fuse is easy. Furthermore, since a glass surface temperature on the outer periphery of the straight portion is low with respect to a surface of the glass tube on an outer periphery of the spiral portion of the heater wire, a temperature fuse which is melted and disconnected at a low temperature can be used and cost thereof is low.

Furthermore, as another method, a defrosting device comprises a glass tube and a heater wire formed of a metal resistor mounted on the glass tube. The heater wire comprises a straight portion at both ends thereof, and a spiral portion. Preferably, a temperature detection device is provided on a glass surface on an outer periphery of one of the straight portions of the heater wire. In this case, when the temperature detection device detects a temperature not lower than a predetermined temperature, input of the heater wire is shielded with a result that a rise in temperature to a value not lower than an ignition temperature of a flammable coolant to be used is further suppressed by the shielding of the input. Furthermore, since a glass temperature on an outer periphery of the straight portions is low with respect to a surface of the glass tube on an outer periphery of the spiral portion of the heater wire, a temperature detection deivce for detection at a low temperature can be used and cost thereof is low.

It is desirable that the temperature detection device conducts a shut-off operation at a temperature which is 310 to 410° C. lower than the ignition temperature of the flammable coolant. In such a case, when temperature of the heater wire rises to a temperature in the vicinity of the ignition temperature of the flammable coolant, the temperature detection device detects a temperature which is 310 to 410° C. lower than the ignition temperature of the flammable coolant to shield input of the defrosting device. Accordingly, a rise in temperature of the heaterwire to a value not lower than the ignition temperature of the flammable coolant can be further suppressed, and furthermore, a relatively cheap temperature detection device can be used and cost thereof is low.

In a case where the defrosting device comprises a glass tube and a heater wire formed of a metal resistor inside the glass tube, and the heater wire is formed of a straight portion at both ends thereof, and a spiral portion formed in a spiral configuration at a remaining portion between both ends, heating value per unit area obtained by dividing a heating value resulting from Joule heat of the spiral portion by a surface area of an inner surface of the glass tube is desirably less than a predetermined quantity. With this structure, a surface temperature of the glass tube can be lowered and a surface temperature of the heater wire can be lowered while securing an entire quantity of heat radiated to an exterior through the glass tube from the heater wire. Furthermore, there is also provided an effect such that a defrosting capability and life that are not lower than a conventional defrosting capability and life can be secured while lowering a surface temperature of the heater wire.

As another method, when a heating value per unit area, obtained by dividing a heating value resulting from Joule heat of a spiral portion of a heater wire by a surface area of an inner surface of a glass tube, is set to lower than 1.6 $W/cm^2$, Joule heat from the heater wire is radiated to an exterior smoothly through the glass tube, so that a surface temperature of the heater wire is lowered. While a defrosting capability and life that are not lower than a conventional defrosting capability and life can be secured, a surface temperature of the heater wire can be lower than an ignition temperature of a flammable coolant to be used. Furthermore, when Joule heat of the heater wire to be used is known, a temperature of the heater wire can be lower than the ignition temperature of the flammable coolant while securing a defrosting capability and life that are not lower than a conventional defrosting capability and life only by determining an inner diameter of the glass tube so that the heating value per unit area of the inner surface of the glass tube becomes lower than 1.6 $W/cm^2$. Thus, design is easy.

Incidentally, preferably, a clearance between the inner surface of the glass tube and the heater wire is 1 mm or less. As a consequence, hindrance of heat transmission with gas present between the glass tube and the heater wire can be decreased, and heat radiated from the heater wire is radiated to the exterior through the glass tube. Furthermore, a quantity of heat radiated to the exterior increases and a defrosting capability is improved while a quantity of heat used in a rise of a heated temperature of the heater wire decreases for the increased portion of the quantity of heat radiated to the exterior with a result that a surface temperature of the heater wire is lowered to a value lower than the ignition temperature of the flammable coolant.

The inner surface of the glass tube and the heater wire may come into contact with each other. In this case, hindrance of heat transmission by gas between the glass tube and the heater wire is removed, so that heat radiated from the heater wire is smoothly radiated to the exterior. Accordingly, a quantity of heat radiated to the exterior further increases and a defrosting capability is further improved while a quantity of heat used in a rise in a heated temperature of the heater wire decreases for an increased portion of the quantity of heat radiated to the exterior. Consequently, a surface temperature of the heater wire is further lowered and can be lower than the ignition temperature of the flammable coolant.

As another method, a roof located above a glass tube is provided, and a minimum distance between an outer surface of the glass tube and the roof may be chosen to be a predetermined value. In this case, the roof decreases a hindrance of gas convection in the vicinity of the glass tube, and heat radiation by convection from the glass tube is improved while heat radiation of a heater wire, which is a heat receiving source of the glass tube, is also improved. Thus, a surface temperature of the heater wire is lowered to a value lower than an ignition temperature of a flammable coolant to be used.

Furthermore, it is desirable that a thickness of the glass tube is 1.5 mm or less. Consequently, heat transmission quantity at a time of transmitting heat, than an inner surface of the glass tube receives from the heater wire, to an outer surface of the glass tube increases so that heat discharged from the heater wire is radiated to the exterior through the glass tube. Accordingly, a quantity of heat radiated to the exterior increases, and a defrosting capability is further improved while a quantity of heat used for a rise in a heated temperature of the heater wire decreases for an increased portion of the quantity of heat radiated to the exterior. Consequently, a surface temperature of the heater wire is further lowered to be lower than the ignition temperature of the flammable coolant.

Alternatively, when the glass tube is made of quartz glass, breakage resulting from a linear swelling difference at a time of temperature change of the glass tube resulting from heating of the heater wire can be prevented, and a direct contact of the leaked flammable coolant with the heater wire can be prevented in a case of leakage of the flammable coolant to an atmosphere of the defrosting device.

A freezing refrigerator according to one preferred embodiment comprises: a refrigerator housing in which a freezing chamber and a refrigerator chamber are completely independent; a cooling system for functionally connecting a compressor, a condenser, a refrigerator chamber cooling device which has a high evaporation temperature for refrigeration, a depression mechanism for a high evaporation temperature having a small depression for a high evaporation temperature, a freezing chamber cooling device having a low evaporation temperature for freezing, which device is connected in parallel with the refrigerator chamber cooling device, a depression mechanism for low evaporation temperature having a large depression for a low evaporation temperature, a change-over valve for controlling that no coolant flows simultaneously to the refrigerator chamber cooling device and the freezing chamber cooling device, and a check valve for preventing a reverse current of the coolant to an outlet of the freezing chamber cooling device to seal a flammable coolant; and a defrosting device for defrosting the freezing chamber cooling device. Since the defrosting device defrosts at a temperature lower than an ignition temperature of the flammable coolant, a frost quantity in the freezing chamber cooling device is decreased because of the fact that all chambers, including the freezing chamber and the refrigerator chamber, are cooled with one cooling device in the prior art while only the freezing chamber is cooled in the freezing refrigerator of the present invention. For completing defrosting in the same amount of defrosting time as in the prior art, a defrosting device with defrosting capability which requires a smaller heating value can be used.

Consequently, an attempt can be made to lower a temperature during use of the defrosting device with a lower heating value. The defrosting device can defrost at a temperature lower than an ignition temperature of the flammable coolant, and energy can be saved.

Preferably, the defrosting device comprises a glass tube and a heater wire formed of a metal resistor inside the glass tube. A roof comprises inclined plates which are inclined in directions opposite to each other. Since respective inclined plates partition each other in a vertical direction, peripheral air which is heated with the defrosting device and rises by convection passes through a central slit of the roof formed between the inclined plates into an above evaporator, so that heat radiation by the defrosting device is promoted. Accordingly, a quantity of heat radiated to an exterior further increases and a defrosting capability is further improved, while for the increased portion of the quantity of heat radiated to the exterior the quantity of heat used in a rise in a heated temperature of the heater wire decreases, so that a surface temperature of the heater wire is further lowered to be lower than an ignition temperature of a flammable coolant to be used.

DETAILED DESCRIPTION OF THE PREFERRED EMBODIMENTS

Figure 31:
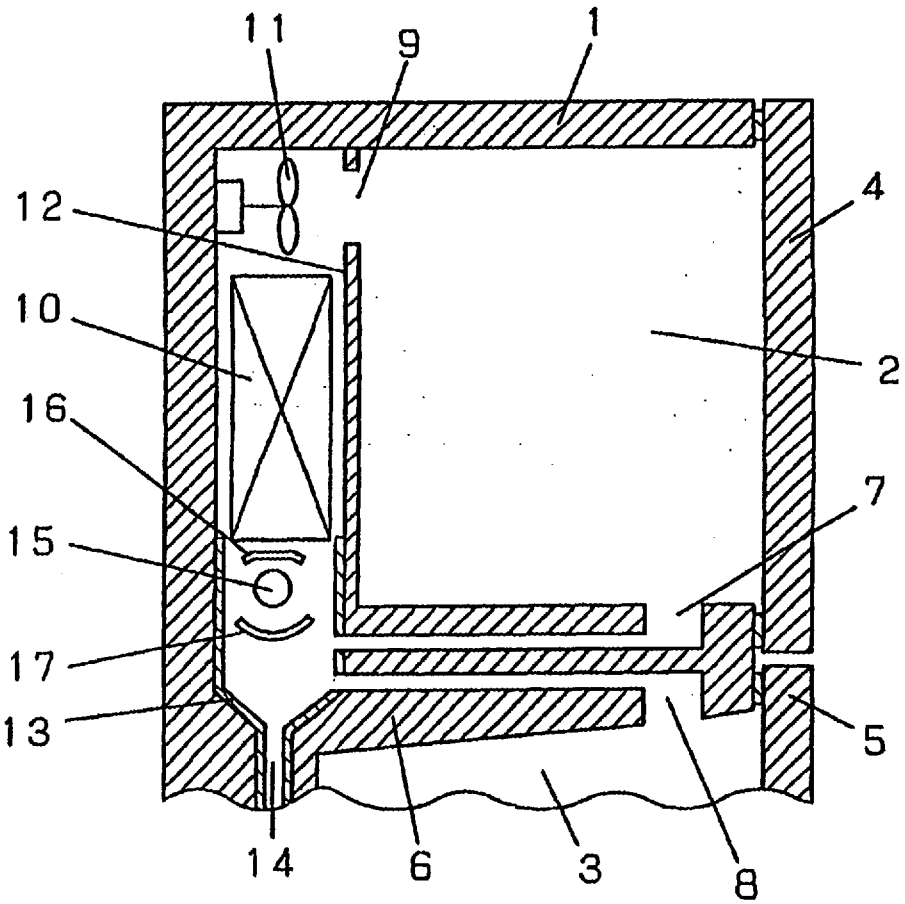
Fig. 31 (PRIOR ART)
FIG. 31 is a schematic vertical sectional view showing an upper portion of a freezing refrigerator according to a conventional freezing refrigerator.

Hereinafter, embodiments of the present invention will be explained in detail by referring to FIGS. 1 through 30. In all the drawings, including FIG. 31 showing a conventional example, the same structure will be denoted with the same reference numerals. Besides, in this specification, a heated temperature (simply referred to as "temperature") of a defrosting device and a heater wire used in previous and subsequent descriptions refers respectively to a temperature of the defrosting device and a heated temperature when the heater wire is electrically operated or excited to radiate heat.

(First Embodiment)

Figure 1:
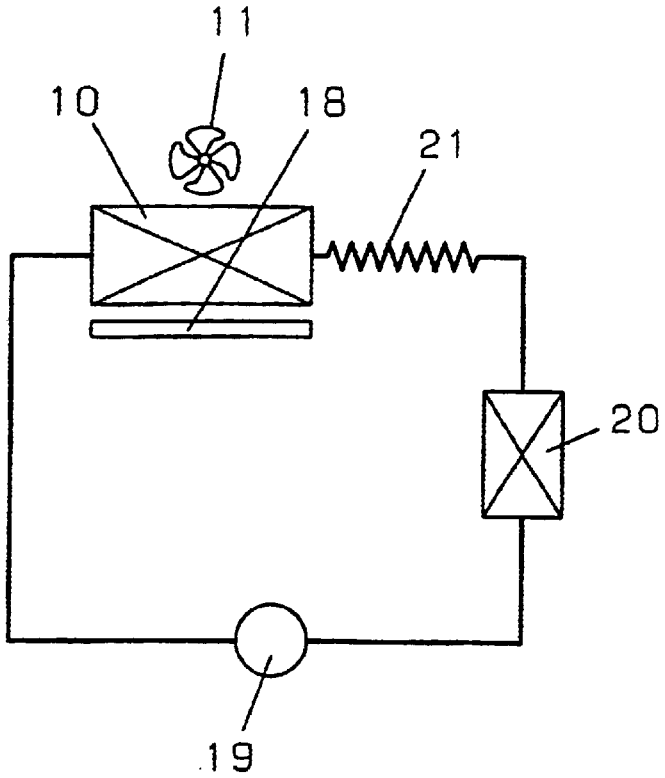
FIG. 1 is a schematic view showing a freezing system of a freezing refrigerator according to a first embodiment of the present invention.

In FIG. 1, reference numeral 18 denotes a defrosting device for defrosting frost which adheres to an evaporator 10. Reference numeral 19 denotes a compressor. Reference numeral 20 denotes a condenser. Reference numeral 21 denotes a depression mechanism. Inside a cooling cycle in which the compressor 19, condenser 20, depression mechanism 21 and evaporator 10 are connected functionally in a ring-like configuration, flammable coolant (not shown) is sealed. This flammable coolant is formed of propane or isobutane as its main component. An ignition point or ignition temperature of the flammable coolant is generally considered to be 450 to 470° C. A freezing refrigerator with this structure is operated as described below.

The evaporator 10 of the cooling cycle is cooled with operation of the compressor 19 with a result that inside air of the freezing refrigerator ventilates the cooled evaporator 10 with a fan 11, which is simultaneously operated with operation of the compressor 19. Then, cool air which is heat exchanged with the evaporator 10 is exhausted to an interior of the refrigerator. Then, the defrosting device is operated after lapse of an arbitrary operating time of the compressor 19.

With operation of this defrosting device 18, the defrosting device 18 generates heat at a temperature lower than the ignition temperature of the flammable coolant used in the cooling cycle so that the defrosting device defrosts the evaporator 10. Completion of defrosting is detected by a detection device (not shown), thereby temporarily suspending a non-cooled state of the inside of the refrigerator by frosting. If the flammable coolant inside of the cooling cycle leaks, the defrosting device 18 comes to have only a temperature lower than the ignition temperature of the flammable coolant used in the cooling cycle with a result that danger of ignition is lowered.

(Second Embodiment)

Figure 2:
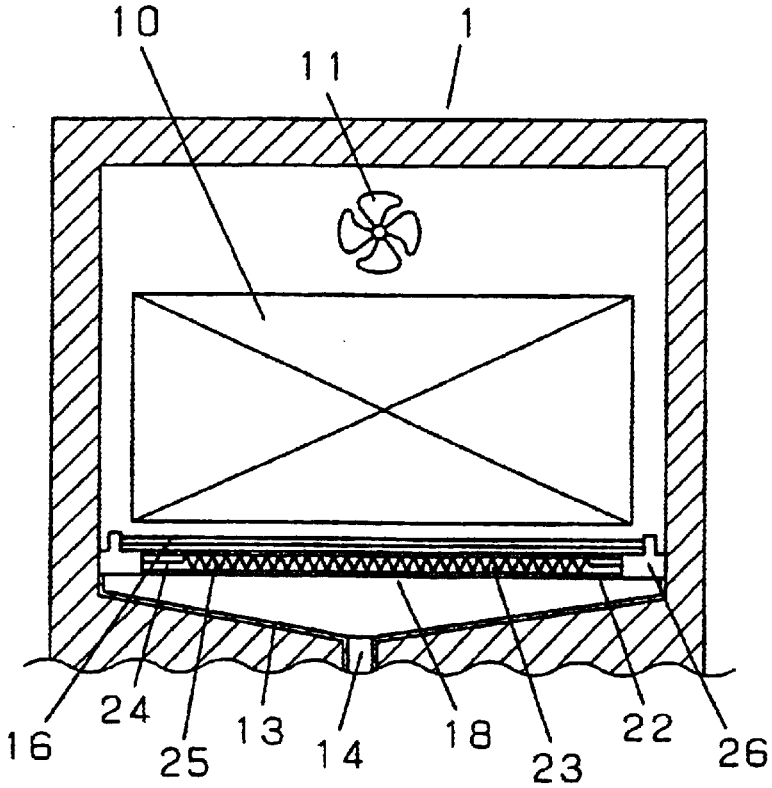
FIG. 2 is a vertical sectional view showing an essential portion of the freezing refrigerator according to a second embodiment of the present invention.

In FIG. 2, reference numeral 22 denotes a glass tube which is a constituent element of defrosting device 18. Reference numeral 23 denotes a heater wire which is a constituent element of the defrosting device 18, and which is formed of a metal resistor located inside the glass tube 22. Reference numeral 24 denotes a straight portion of the heater wire 23 formed linearly at both end portions of the heater wire. Reference numeral 25 denotes a spiral portion of the heater wire 23 excluding the straight portions 24, with the spiral portion being formed in a spiral configuration so as to be accommodated to a length of the glass tube 22 within which the heater wire is defined. Reference numeral 26 denotes a cap for preventing frost water from infiltrating into an interior of the glass tube 22. In a freezing refrigerator having this structure, when the defrosting device 18 is operated, a portion of the heater wire 23 is affected by mutually adjacent portions of the heater wire 23, and is ignited at a temperature at which a heated temperature of the spiral portion 25, which rises in temperature, is lower than the ignition temperature of a flammable coolant to be used. Consequently, frost of evaporator 10 is melted to become water and is dripped from the evaporator 10. A portion of the dripped water is not directly dripped to the glass tube 22, and dripped water falls to basin 13 from roof 16 and the caps 26 while remaining water is directly dripped to the basin 13 with a result that the water dripped to the basin 13 is exhausted from drain port 14 to an exterior thereof.

Accordingly, a majority of heat radiated from the heater wire 23, which is a heating body, is radiated to frost, which has adhered to the evaporator 10 and peripheral parts, through the glass tube 22. Consequently, a surface temperature of the heater wire 23 which is electrically excited becomes lower than the ignition temperature of the flammable coolant. Furthermore, the heater wire 23 can prevent corrosion and deterioration owing to direct contact of defrosted water with the caps 26. Thus, danger of ignition can be extremely lowered even when defrosting is conducted in a case where defrosting capability and life is secured to the same level as, or more than, a conventional level and the flammable coolant is leaked to an atmosphere of the defrosting device 18.

(Third Embodiment)

Figure 3:
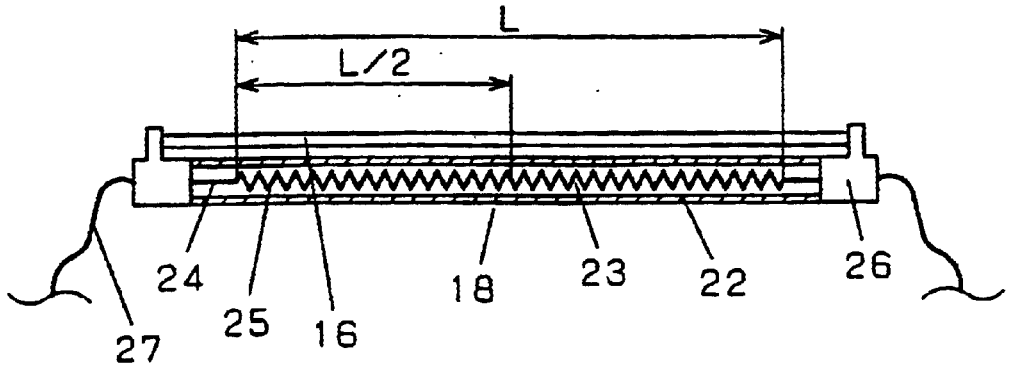
FIGS. 3 through 5 are schematic vertical sectional views showing respective heaters as defrosting devices used in third to fifth embodiments of the invention.

As shown in FIG. 3, reference numeral 27 denotes a lead wire connected to both ends of heater wire 23. Symbol L denotes a length of spiral portion 25. When defrosting device 18 is operated with this structure, the heater wire 23 is input through the lead wires 27 to generate heat. Then, the heater wire 23 generates heat at a temperature lower than the ignition temperature of the flammable coolant at a central portion shown by L/2, at which temperature rises in the spiral portion, thereby defrosting evaporator 10.

Accordingly, because a surface temperature of the central portion, in a length direction, of the spiral portion 25 of the heater wire 23, which rises in value, is lower than an ignition temperature of a flammable coolant to be used while securing defrosting capability and life to be the same as, or more than, conventional defrosting capability and life, danger of ignition is further lowered even when defrosting is conducted when flammable coolant is leaked to an atmosphere of the defrosting device 18.

(Fourth Embodiment)

Figure 4:
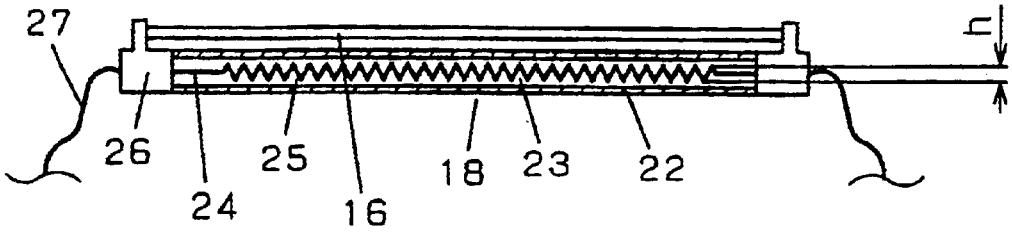

As shown in FIG. 4, symbol h denotes a height of spiral portion 25. Here, during a defrosting time, gas in the vicinity of heater wire 23 is warmed with heating of the heater wire to move in an upward direction with a result that gas in glass tube 22 is heated at an upper portion more than at a lower portion. Under this influence, the heater wire 23 has a height h of the spiral portion 25 so that temperature at an upper portion of the spiral portion 25 rises. A surface temperature of the spiral portion 25 of the heater wire 23 which comes to have a higher temperature is heated at a temperature lower than an ignition temperature of a flammable coolant to be used so that evaporator 10 is defrosted.

Accordingly, while securing defrosting capability and life to be the same as, or more than, conventional defrosting capability and life, further danger of ignition can be lowered, even when defrosting is conducted in a case where the flammable coolant is leaked to an atmosphere of defrosting device 18, by setting a temperature of the upper portion of the spiral portion 25, which becomes high relative to other temperatures of the heater wire 23, lower than the ignition temperature of the flammable coolant.

(Fifth Embodiment)

Figure 5:
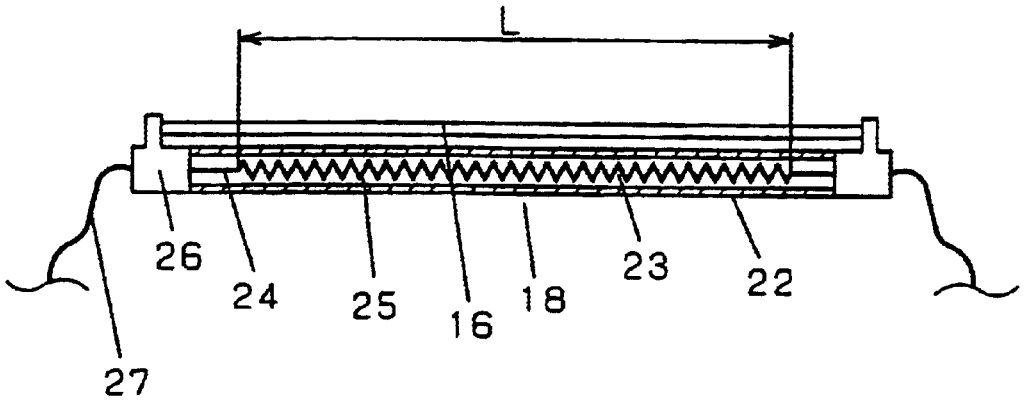
Figure 6:
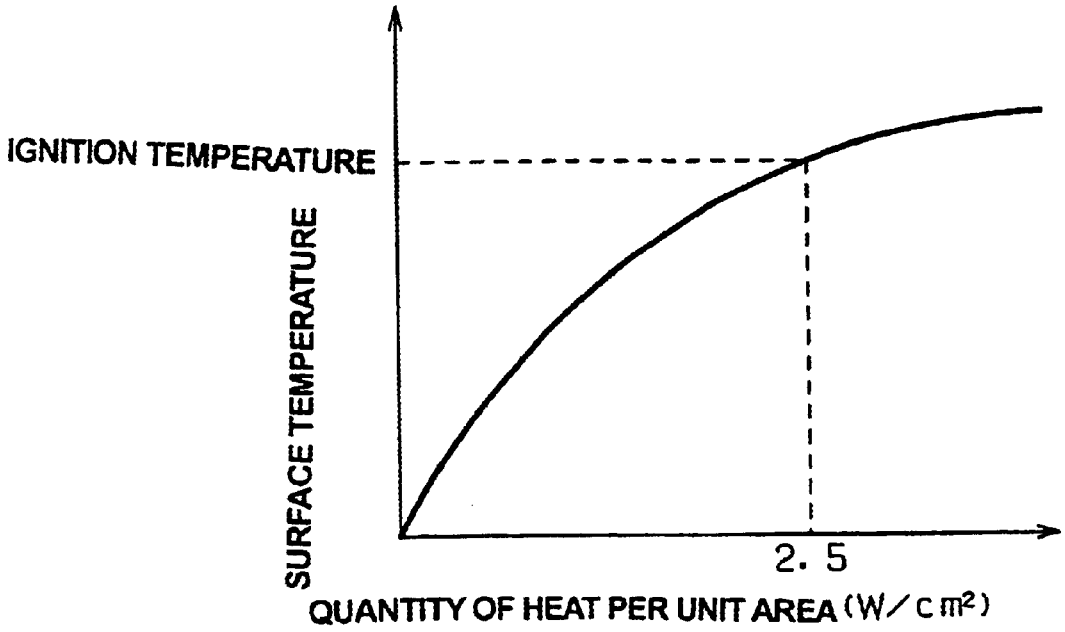
FIG. 6 is a graph corresponding to the fifth embodiment of the present invention.

In FIG. 5, symbol L denotes a length of a spiral portion 25. Furthermore, as shown in FIG. 6, the horizontal axis represents a heating value per unit area, which value is obtained by dividing a heating value of Joule heat of heater wire 23 present in length L of the spiral portion 25 by a surface area of the heater wire 23 present in length L of the spiral portion 25, while the vertical axis represents a surface temperature of the heater wire 23. In a freezing refrigerator which is constituted in this manner, the heater wire 23 is electrified with electricity through lead wires 27 at a defrosting time, so that the heater wire 23 is heated with Joule heat. At this time, defrosting device 18 defrosts evaporator 10 at a heating value of lower than 2.5 $W/cm^2$ per unit area of the heater wire 23 at a portion present in length L of the spiral portion 25.

Here, surface temperature of the heater wire 23 rises with an increase in quantity of heat per unit area of the spiral portion 25 of the heater wire 23. When quantity of heat per unit area exceeds 2.5 $W/cm^2$, surface temperature of the heater wire 23 becomes not lower than an ignition temperature of a flammable coolant to be used.

Accordingly, temperature of the heater wire 23 can be lower than the ignition temperature of the flammable coolant while securing defrosting capability and life to be the same as, or more than, conventional defrosting capability and life. Even when defrosting is conducted in a case where the flammable coolant is leaked to an atmosphere of defrosting device 18, danger of ignition can be further lowered. Furthermore, when an entire heating value of the heater wire 23 is increased, surface temperature of the heater wire 23 rises. However, since temperature of the heater wire 23 can be lower than the ignition temperature of the flammable coolant irrespective of the entire heating value of the heater wire 23 by designing the fifth embodiment in such a manner that heating value per unit area becomes 2.5 $W/cm^2$ even when the entire heating value is increased, design of the defrosting device 18 for setting the flammable coolant to a temperature lower than the ignition temperature can be facilitated, so that the entire heating value of the heater wire 23 can be increased while being maintained lower than the ignition temperature of the flammable coolant.

Incidentally, in the fifth embodiment, there is shown a case in which isobutane is used as the flammable coolant. When other flammable coolants are used that do not have a largely different ignition temperature, the same effect can be provided.

Furthermore, according to the fifth embodiment, a heated temperature of the heater wire 23 is lower than an ignition temperature of isobutane. Specifically, in a case where isobutane coolant is used, a heated temperature of isobutane is required to be about 360° C. or lower in consideration of a safety ratio with respect to the ignition temperature of isobutane which stands at about 460° C. In this case, a heating value per unit area is 0.67 $W/cm^2$ or lower.

(Sixth Embodiment)

Figure 8:
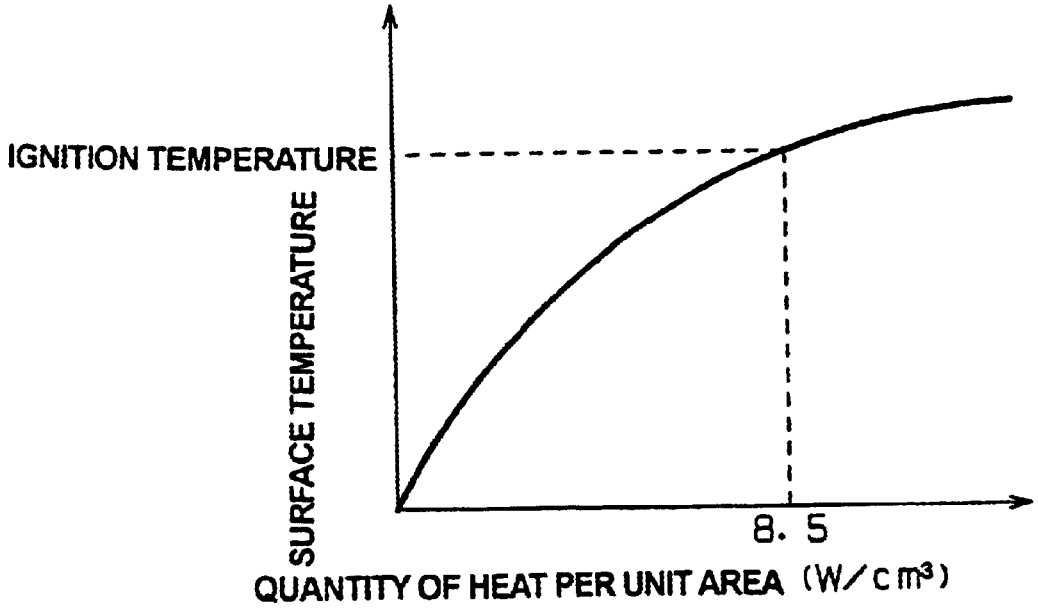
FIG. 8 is a graph corresponding to the sixth embodiment of the present invention.
Figure 7:
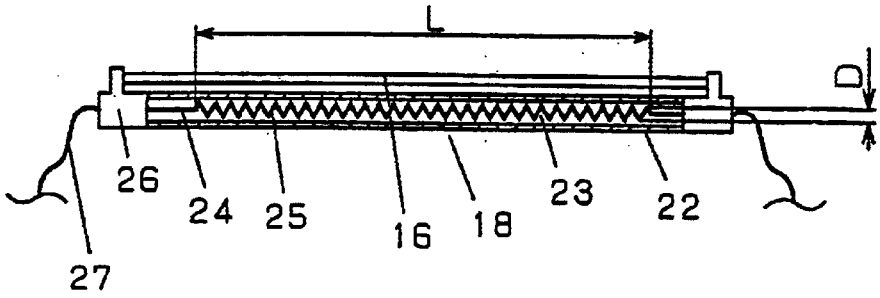
FIG. 7 is a schematic vertical sectional view showing a heater as a defrosting device used according to a sixth embodiment of the present invention.

In FIG. 7, symbol D denotes an outer diameter of spiral portion 25. Furthermore, the horizontal axis in FIG. 8 represents a heating value per unit area obtained by dividing a heating value of Joule heat of heater wire 23 present within length L of the spiral portion 25 by a volume defined by length L and the outer diameter D of the spiral portion 25, while the vertical axis represents a surface temperature of the heater wire 23. With this structure, at a defrosting time, defrosting device 18 defrosts evaporator 10 at a heating value per unit area of lower than 8.5 $W/cm^3$, which value is obtained by dividing the heating value of the Joule heat of the heater wire 23 present in length L of the spiral portion 25 by the volume defined by length L and outer diameter D of the spiral portion 25. Here, surface temperature of the heater wire 23 rises along with a rise in a heating value per unit area of the spiral portion 25. When this heating value per unit area exceeds 8.5 W/cm$^3$, the surface temperature becomes not lower than an ignition temperature of a flammable coolant to be used.

Accordingly, temperature of the heater wire 23 can be lower than the ignition temperature of the flammable coolant while securing defrosting capability and life to be the same as, or more than, conventional defrosting capability and life. Even when defrosting is conducted in a case where the flammable coolant is leaked to an atmosphere of the defrosting device 18, danger of ignition can be further lowered. Furthermore, in a case where the outer diameter D of the spiral portion 25 is changed, temperature of the heater wire 23 can be lower than the ignition temperature of the flammable coolant without affecting the outer diameter D of the spiral portion 25 of the heater wire 23 by designing the sixth embodiment in such a manner that a heating value is determined with respect to the volume calculated from the outer diameter D and length L of the spiral portion 25. Consequently, design of the defrosting device 18 for setting a temperature lower than the ignition temperature of the flammable coolant can be further facilitated. It is possible to freely change the outer diameter D of the spiral portion 25 and an entire heating value of the heater wire 23 while maintaining a temperature lower than the ignition temperature of the flammable coolant.

Incidentally, in the sixth embodiment, there is shown a case in which isobutane is used as the flammable coolant. Other types of coolants, which have an ignition temperature not largely different from isobutane, have the same effect.

(Seventh Embodiment)

Figure 9:
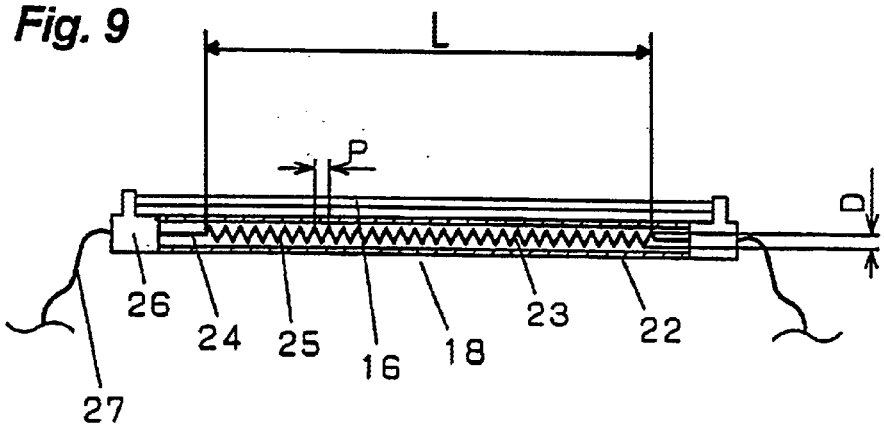
FIG. 9 is a schematic vertical sectional view showing a heater as a defrosting device used according to a seventh embodiment of the present invention.
Figure 10:
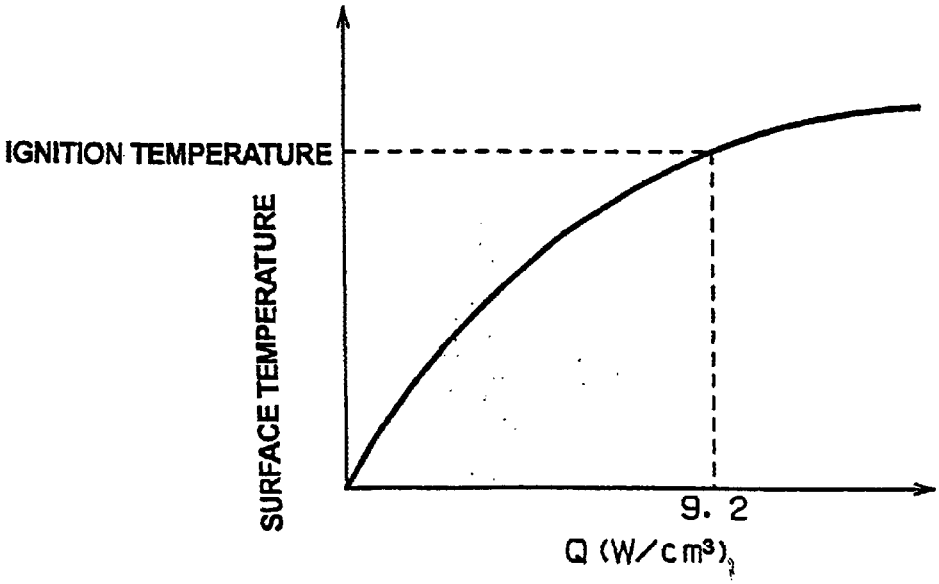
FIG. 10 is a graph corresponding to the seventh embodiment of the present invention.

In FIG. 9, symbol P denotes a pitch of spiral portion 25. Furthermore, the horizontal axis in FIG. 10 represents a heating value Q which is obtained by subtracting a heating value per unit area, obtained by dividing a heating value of Joule heat present in length L of the spiral portion 25 by a surface area, from a coefficient obtained by dividing the pitch P by outer diameter D, while the vertical axis represents a surface temperature of heater wire 23. With respect to a freezing refrigerator having such structure, operation will be explained hereinbelow.

At a defrosting time, defrosting device 18 conducts defrosting of evaporator 10 at a heating value Q of lower than 9.2 W/cm$^2$. Here, surface temperature of the heater wire 23 rises along with an increase in the heating value Q so that heat temperature becomes a temperature not lower than an ignition temperature of a flammable coolant to be used when the heating value Q exceeds 9.2 W/cm$^2$. Accordingly, a temperature of the heater wire 23 can be lower than the ignition temperature of the flammable coolant while securing defrosting capability and life to be not lower than conventional defrosting capability and life. Consequently, even when defrosting is conducted in a case of leakage of the flammable coolant to an atmosphere of the defrosting device 18, danger of ignition can be lowered.

Furthermore, even in a case where the pitch P and the diameter D of the spiral portion 25 are changed, a temperature of the flammable coolant can be lower than the ignition temperature of the flammable coolant without affecting the change of the pitch and the outer diameter of the spiral portion by designing the spiral portion 25 so that the heating value Q becomes lower than 9.2 W/cm$^2$. Consequently, design of the defrosting device 18 for setting a temperature to lower than the ignition temperature of the flammable coolant can be facilitated, and the pitch and the diameter of the spiral portion 25, and an entire heating value of the heater wire 23, can be freely changed while maintaining the temperature lower than the ignition temperature of the flammable coolant.

Incidentally, according to the seventh embodiment, there is shown a case in which isobutane is used as the flammable coolant. Other flammable coolants, which have not largely different ignition temperatures, can have the same effect.

(Eighth Embodiment)

Figure 11:
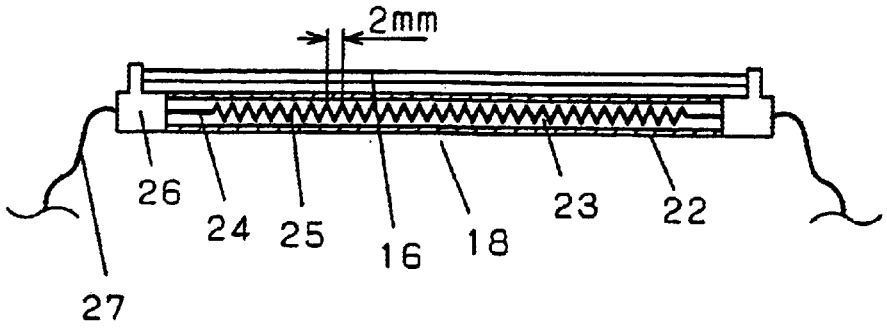
FIGS. 11 and 12 are schematic vertical sectional views showing respective heaters as defrosting device used in eighth and ninth embodiments of the present invention.

Referring to FIG. 11, a pitch of spiral portion 25 is 2 mm. In a freezing refrigerator using a defrosting device comprising such a heater wire, defrosting device 18 is operated and electrification of the heater wire 23 is started, and the spiral portion 25 comes to have a higher temperature under influence of mutually adjacent portions of the heater wire 23. At this time, a heated temperature at each part of the spiral portion 25 is changed and scattered because of a change in an influence degree of the mutually adjacent portions of the heater wire resulting from unevenness in pitch at a time of processing. However, since the pitch of the spiral portion 25 is 2 mm, influence from the mutually adjacent portions of the heater wire can be decreased and unevenness can be suppressed.

Accordingly, since temperature unevenness can be decreased, which results from unevenness in pitch of the spiral portion 25, the heater wire 23 as a whole comes to have a temperature lower than an ignition temperature of a flammable coolant to be used. Consequently, even when defrosting is conducted in a case of leakage of the flammable coolant to an atmosphere of the defrosting device 18, danger of ignition can be lowered. Incidentally, the pitch is 2 mm in the eighth embodiment, but the same effect can be obtained when the pitch is more than 2 mm.

(Ninth Embodiment)

Figure 12:
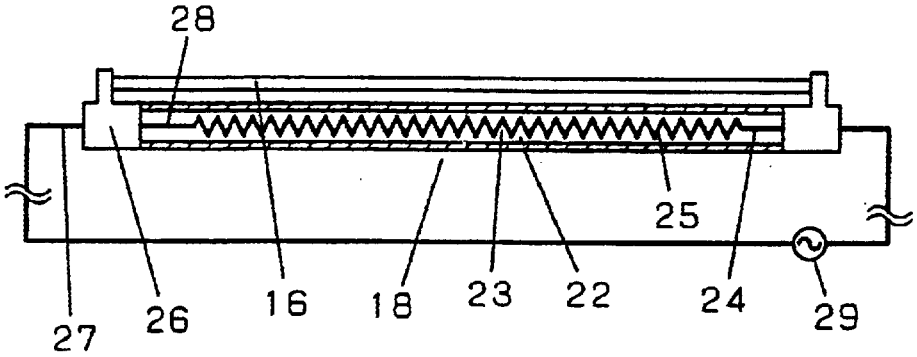

As shown in FIG. 12, reference numeral 28 denotes a metal which is melted and disconnected at a predetermined temperature lower than an ignition temperature of a flammable coolant to be used. Reference numeral 29 denotes a power source.

In the ninth embodiment, at a defrosting time, electrification of heater wire 23 of defrosting device 18 is started from the power source 29. Then, there is a possibility that a temperature of the heater wire 23 becomes not lower than the ignition temperature of the flammable coolant in a case where a high voltage is applied as a voltage change. At this time, when the heater wire 23 attains a predetermined temperature lower than the ignition temperature of the flammable coolant, heat is transmitted to the metal 28 and the metal 28 is melted and electrification of the heater wire 23 from the power source 29 is shielded with a result that heating of the heater wire 23 is lost and its temperature is lowered.

Accordingly, even when defrosting is conducted in a case of leakage of the flammable coolant to an atmosphere of the defrosting device 18, danger of ignition can be lowered.

(Tenth Embodiment)

Figure 13:
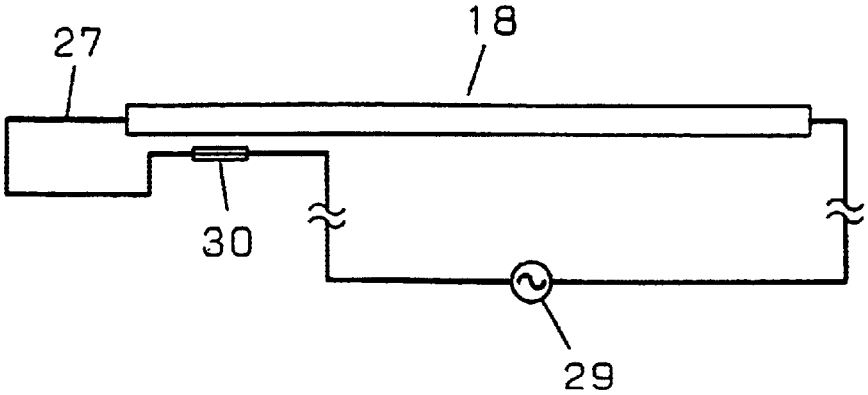
FIGS. 13 through 17 are wiring views showing respective heaters according to a tenth to a fourteenth embodiment of the present invention.

As shown in FIG. 13, reference numeral 30 denotes a temperature fuse which is melted and disconnected at a predetermined temperature lower than an ignition temperature of a flammable coolant to be used. There is a possibility that a surface temperature of heater wire 23 becomes a temperature not lower than the ignition temperature of the flammable coolant in a case of application of a high voltage as a voltage change. In a case where the temperature fuse 30 is used, the temperature fuse is melted when a temperature of defrosting device 18 attains a predetermined temperature lower than the ignition temperature of the flammable coolant with a result that input to the defrosting device 18 from power source 29 is shielded and a heated temperature of the defrosting device 18 ceases to rise.

Accordingly, a rise in temperature of the heater wire 23 to a temperature not lower than the ignition temperature of the flammable coolant is suppressed. Consequently, even when defrosting is conducted in a case of leakage of the flammable coolant to an atmosphere of the defrosting device 18, danger of ignition can be lowered, while only the temperature fuse 30 need be replaced in a case where the temperature fuse is damaged under a certain influence and the defrosting device 18 has no problem. Thus, maintenance is easy.

(Eleventh Embodiment)

Figure 14:
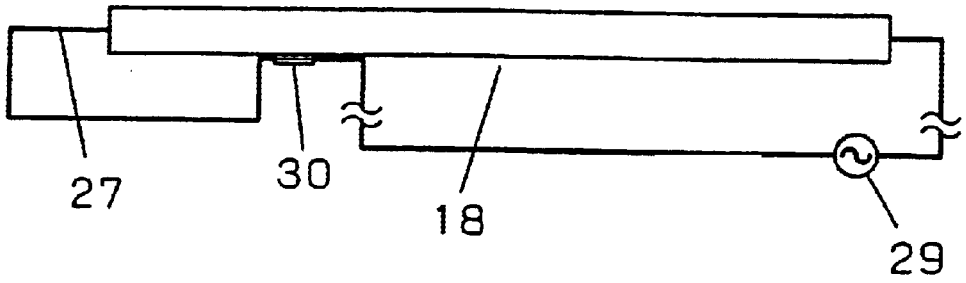

As shown in FIG. 14, reference numeral 30 denotes a temperature fuse formed of a metal which is melted and disconnected at a predetermined temperature lower than an ignition temperature of a flammable coolant to be used. With respect to a freezing refrigerator which is configured in this manner, operation will be explained hereinbelow.

At a time of operation of defrosting device 18, the temperature fuse 30 is mounted in close contact with an outer periphery of a hull of the defrosting device 18 which comes into contact with gas in the refrigerator. For example, there is a possibility that a surface temperature of a heater wire (not shown) becomes not lower than the ignition temperature of the flammable coolant in a case where a high voltage is applied as a voltage change. At this time, when a temperature of the hull of the defrosting device becomes a predetermined temperature lower than the ignition temperature of the flammable coolant, heat is favorably transmitted to the temperature fuse 30, which is mounted in close contact with the hull of the defrosting device 18, with a result that a temperature of the temperature fuse 30 becomes a predetermined temperature lower than the ignition temperature of the flammable coolant so as to be melted to provide a liquid which is dripped. Then, input to the defrosting device 18 is shielded at a portion of the temperature fuse 30, and a rise in temperature of the defrosting device 18 is suspended.

Accordingly, since a temperature at a portion which contacts gas inside the defrosting device 18 can be accurately transmitted to the temperature fuse 30, the defrosting device 18 can more accurately suppress a temperature rise before attaining the ignition temperature of the flammable coolant. Consequently, even when the defrosting device is conducted in a case of leakage of the flammable coolant to an atmosphere of the defrosting device 18, danger of ignition can be further lowered, while maintenance of the temperature fuse 30 in a case of absence of a problem with the defrosting device 18 can be facilitated.

(Twelfth Embodiment)

Figure 15:
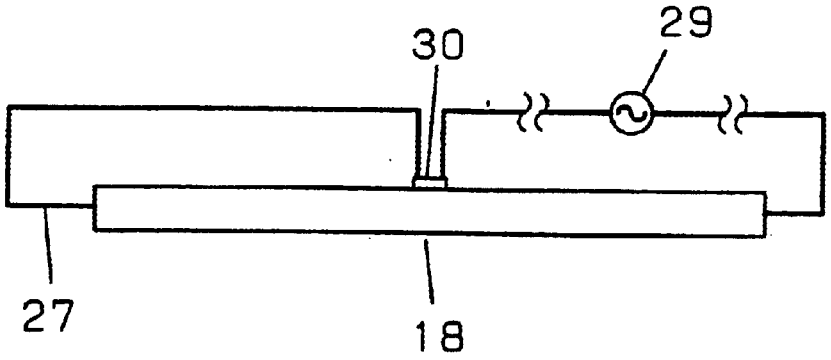

As shown in FIG. 15, temperature fuse 30 is mounted on an upper portion of a hull of defrosting device 18. At a time of operation of the defrosting device 18, since gas in the vicinity of the hull of the defrosting device 18 is warmed and moves upward with heating, an upper portion of the defrosting device 18 comes to have a high temperature with respect to a lower portion thereof. Then, there is a possibility that a surface temperature of a heater wire (not shown) becomes not lower than an ignition temperature of a flammable coolant to be used in a case where a high voltage is applied as a voltage change. At this time, when a high temperature portion of the defrosting device 18 becomes a predetermined portion having a temperature lower than the ignition temperature of the flammable coolant, the temperature fuse 30 is melted and disconnected, and input to the defrosting device 18 is shielded to suppress a rise in temperature.

Accordingly, the temperature fuse 30 is operated by detecting a temperature of the upper portion of the defrosting device 18, which portion is a high temperature portion in a vertical direction of the defrosting device 18. Consequently, a rise in temperature of the defrosting device in its entirety to a temperature not lower than the ignition temperature of the flammable coolant can be further suppressed with a result that danger of ignition can be lowered further even when defrosting is conducted in a case of leakage of the flammable coolant to an atmosphere of the defrosting device 18. At the same time, maintenance of the temperature fuse 30 in a case of no problem with the defrosting device 18 is easy.

(Thirteenth Embodiment)

Figure 16:
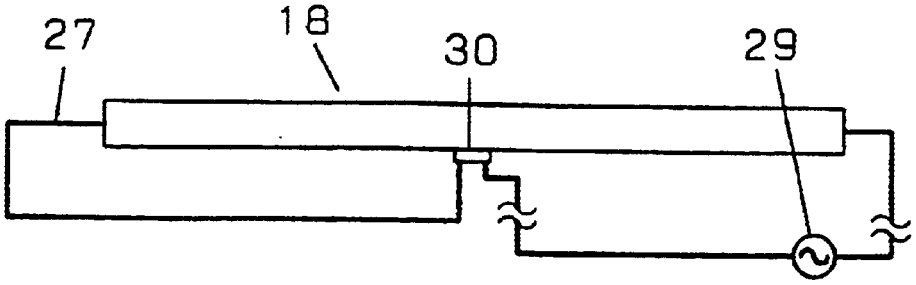

In FIG. 16, temperature fuse 30 is mounted on a lower portion of a hull of defrosting device 18. At a defrosting time, frost melted from an evaporator (not shown) or the like located above the defrosting device 18 forms defrost water, so that some water is indirectly dripped while remaining water is directly dripped to a basin (not shown). The defrost water which has dripped to the defrosting device 18 comes into contact with an upper portion of the defrosting device 18 to be evaporated. However, little defrost water is dripped to the temperature fuse 30 located at a lower portion of the defrosting device 18.

Accordingly, there is provided an effect such that a heated temperature of the defrosting device 18 can be accurately detected, and a rise in temperature of the defrosting device to a temperature not lower than an ignition temperature of a flammable coolant to be used can be more accurately suppressed because of absence of a temperature drop owing to direct contact of the defrost water which is dripped from the evaporator located at an upper portion of the defrosting device 18 at a time of rise of surface temperature of the heater wire (not shown) to a temperature of not lower than the ignition temperature of the flammable coolant in a case of application of a high voltage as a voltage change. There is also an effect such that danger of ignition can be further lowered even when defrosting is conducted in a case of leakage of the flammable coolant to an atmosphere of the defrosting devicve 18, while maintenance of the temperature fuse 30 in a case of no problem with the defrosting device 18 is easy.

(Fourteen Embodiment)

Figure 17:
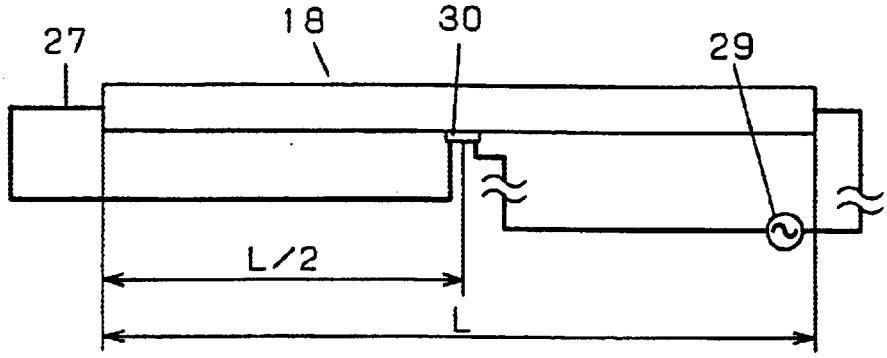

In FIG. 17, temperature fuse 30 is mounted on a hull in the vicinity of a central portion (L/2) of defrosting device 18. Since both ends of the defrosting device 18 come into contact with outside air, heat exchange is conducted with the outside air, and temperature is lowered so as to be less than that of the central portion. Consequently, the central portion of the defrosting device 18 becomes a high temperature portion. Then, there is a possibility that a surface temperature of a heater wire (not shown) becomes not lower than an ignition temperature of a flammable coolant to be used in a case where a high voltage is applied as a voltage change. At this time, when the central portion, which is a high temperature portion of the defrosting device 18, comes to have a predetermined temperature, the temperature fuse 30 which is mounted on a portion in close contact therewith is melted and disconnected, and input to the defrosting device 18 is shielded to suppress a rise in temperature.

Accordingly, since the temperature fuse 30 is operated by detecting a heated temperature of the central portion, which is a high temperature portion in a length direction of the defrosting device 18, a rise in temperature to not lower than the ignition temperature of the flammable coolant of the defrosting device 18 in its entirety can be suppressed, and danger of ignition can be lowered even when defrosting is conducted in a case of leakage of the flammable coolant into an atmosphere of the defrosting device 18, while maintenance of the temperature fuse 30 in a case of no problem with the defrosting device 18 is easy.

(Fifteenth Embodiment)

Figure 18:
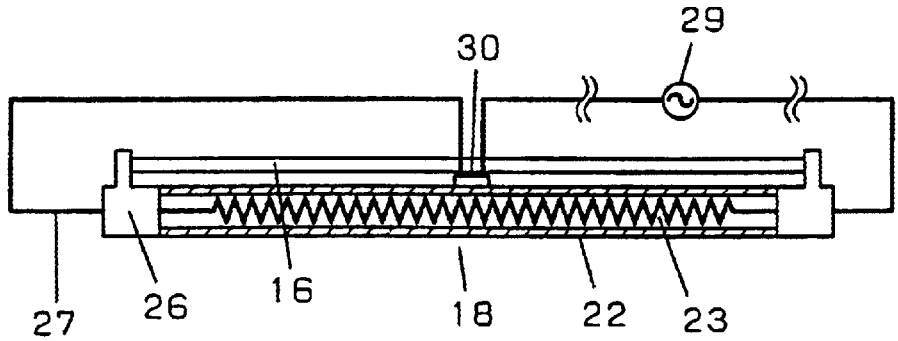
FIGS. 18 and 19 are schematic vertical sectional views showing respective heaters according to a fifteenth and a sixteenth embodiment of the present invention.

As shown in FIG. 18, temperature fuse 30 is melted and disconnected at a temperature which is 100 to 200° C. lower than an ignition temperature of a flammable coolant to be used. For example, there is a possibility that a surface temperature of heater wire 23 becomes not lower than the ignition temperature of the flammable coolant in a case where a high voltage is applied as a voltage change. At this time, when the heater wire 23, which is a heating body, comes to have a predetermined temperature in the vicinity of the ignition temperature of the flammable coolant, but lower than the ignition temperature thereof, a surface of glass tube 22 on an outer periphery of the heater wire 23 comes to have a temperature which is 100 to 200° C. lower than the predetermined temperature with heat lost when heat is transmitted from the heater wire 23 to the glass tube 22. Then, the temperature fuse 30, which is mounted on a surface of the glass tube 22 in close contact therewith, is melted and disconnected, and an input to the heater wire 23 is shielded to suppress a rise in temperature.

Accordingly, in a defrosting device having a heater wire 23 inside of a glass tube 22, a rise in temperature to not lower than an ignition temperature of an inflammable coolant to be used can be accurately suppressed. Even when defrosting is conducted in a case of leakage of the flammable coolant into an atmosphere of defrosting device 18, danger of ignition can be lowered while maintenance of the temperature fuse 30 in a case of no problem with the defrosting device 18 is easy.

(Sixteenth Embodiment)

Figure 19:
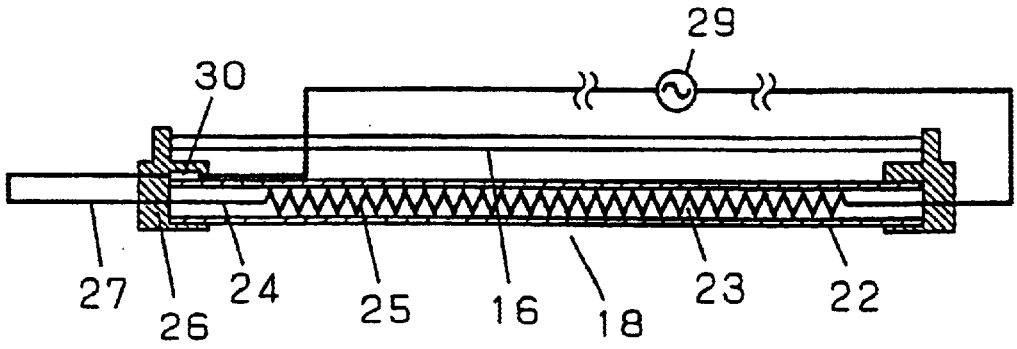

In FIG. 19, temperature fuse 30 is mounted on a surface of glass tube 22 on an outer periphery of straight portion 24 of heater wire 23 and is fixed to the glass tube 22 in close contact therewith with a cap 26. Consequently, at a time of operation of defrosting device 18, the heater wire 23 of the defrosting device rises with Joule heat so that heat is transmitted to the glass tube 22 on an outer periphery of the heater wire 23 while temperature of the glass tube 22 also rises in association with the heater wire 23. At this time, the straight portion 24 of the heater wire 23 comes to have a lower temperature because of smaller influence from adjacent mutual portions of the heater wire, like spiral portion 25, so that the outer periphery of the straight portion 24 in the glass tube comes to have a lower temperature as well. Then, when the heater wire attains a certain temperature lower than an ignition temperature of a flammable coolant to be used, the glass tube 22 on the outer periphery of the straight portion 24 comes to have a predetermined temperature lower than a heated temperature of the heater wire 23 with a result that metal of the temperature fuse 30 is melted and disconnected, and electrification of the heater wire 23 is shielded, and the heated temperature of heater wire 23 is thus lowered.

Accordingly, defrosting device 18 can suppress a rise in temperature before attaining the ignition temperature of the flammable coolant so that danger of ignition can be lowered even when defrosting is conducted in a case of leakage of the flammable coolant to an atmosphere of the defrosting device 18, while maintenance of the temperature fuse 30 in a case of no problem with the defrosting device 18 is easy. Furthermore, since the temperature fuse 30 detects a low temperature of a portion associated with the heated temperature of the heater wire 23 to operate the heater wire 23, a cheaper fuse can be used as compared with a temperature fuse for a high temperature.

Incidentally, in the sixteenth embodiment, since the cap 26 functions also as a holder of the temperature fuse 30, the temperature fuse 30 is mounted on a portion of the cap 26. It goes without saying that the same effect can be provided when the heater wire 23 is mounted on the surface of the glass tube 22 on the outer periphery of the straight portion 24 of the heater wire 23.

(Seventeenth Embodiment)

Figure 20:
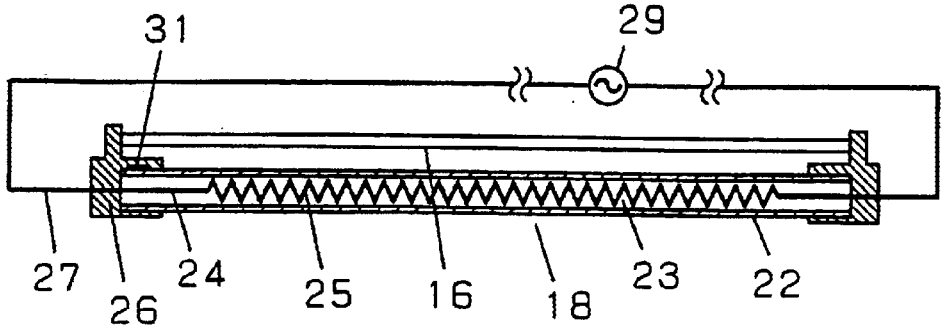
FIG. 20 is a schematic vertical sectional view showing a heater according to a seventeenth embodiment and an eighteenth embodiment of the present invention.

As shown in FIG. 20, reference numeral 31 denotes a temperature detection device. When the temperature detection device detects a predetermined temperature, electrification of heater wire 23 of defrosting device 18 from power source 29 is shielded. Then, at a time of operation of the defrosting device, the heater wire 23 of the defrosting device 18 comes to have a higher temperature with Joule heat, so that heat is transmitted to glass tube 22 on an outer periphery of the heater wire 23 and temperature of the glass tube 22 also rises in association with the heater wire 23. At this time, since straight portion 24 is affected little by mutually adjacent portions of the heater wire, i.e. spiral portion 25, a temperature of the straight portion is lowered so that a temperature of a portion on an outer periphery of the straight portion 24 is lowered in the glass tube 22. Then, when the heater wire 23 comes to have a temperature lower than an ignition temperature of a flammable coolant to be used, temperature of the glass tube 22 on the outer periphery of the straight portion 24 attains a predetermined temperature lower than a heated temperature of the heater wire 23 with a result that the temperature detection device 31 detects the predetermined temperature to shield electrification of the heater wire 23, and the heated temperature of the heater wire 23 is lowered.

Accordingly, the defrosting device 18 can suppress a rise in temperature before attaining the ignition temperature of the flammable coolant. In a case where the flammable coolant is leaked to an atmosphere of the defrosting device 18, danger of ignition can be lowered even when defrosting is conducted. Furthermore, since the temperature detection device 31 detects a low temperature at a portion which is associated with the heated temperature of the heater wire 23, a cheaper temperature detection device can be used as compared with a higher temperature detection device.

Incidentally, according to the seventeenth embodiment, since cap 26 also serves as a holder of the temperature detection device 31, the temperature detection device 31 is mounted in a portion of the cap. It goes without saying that the same effect can be obtained when the temperature detection device is mounted on a surface of the glass tube 22 on an outer periphery of the straight portion 24 of the heater wire 23.

(Eighteenth Embodiment)

As shown in FIG. 20, reference numeral 31 denotes a temperature detection device. The temperature detection device 31 detects a temperature which is 310 to 410° C. lower than an ignition temperature of a flammable coolant to be used. When the temperature detection device 31 detects that temperature, electrification of heater wire 23 of defrosting device 18 from power source 29 is shielded. At a time of the operation of the defrosting device, the heater wire 23 comes to have a higher temperature by Joule heat, and heat is transmitted to glass tube 22 on an outer periphery of the heater wire 23, so that a temperature of the glass tube 22 also rises in association with the heater wire 23. At this time, in the heater wire 23 as well, since straight portion 24 thereof is affected little by the mutually adjacent portions of the heater wire, like the spiral portion 25, a temperature is lowered while a temperature at a portion on the outer periphery of straight portion 24 is lowered. Then, when heater wire 23 comes to have a temperature in the vicinity of the ignition temperature of the flammable coolant, a temperature of the glass tube 22 on an outer periphery of the straight portion 24 becomes a temperature 310 to 410° C. lower than a former temperature of the glass tube 22. At that time, the temperature detection device 31 detects a temperature and shields electrification of the heater wire 23, and a heated temperature of the heater wire 23 does not attain the ignition temperature of the flammable coolant and is lowered.

Accordingly, temperature rise can be accurately suppressed before attaining the ignition temperature of the flammable coolant. Even when defrosting is conducted in a case of leakage of the flammable coolant to an atmosphere of the defrosting device 18, danger of ignition can be suppressed while the temperature detection device 31 detects a low temperature at a portion associated with the heated temperature of the heater wire 23. Consequently, a cheaper temperature detection device, as compared with a temperature device for a high temperature, can be used.

(Nineteenth Embodiment)

Figure 21:
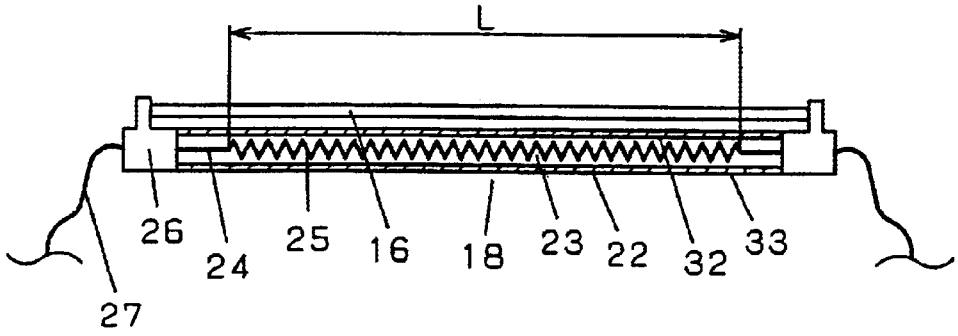
FIG. 21 is a schematic vertical sectional view showing a heater according to a nineteenth embodiment and a twentieth embodiment of the present invention.

As shown in FIG. 21, reference numeral 32 denotes a glass tube inner surface of glass tube 22. Reference numeral 33 denotes a glass tube outer surface of the glass tube 22. Symbol L denotes a length of a spiral portion 25.

At a defrosting time, heater wire 23 is electrified through a lead wire 27, and the heater wire 23 is heated with Joule heat. At this time, defrosting device 18 defrosts an evaporator (not shown) when a Joule heating value per unit area of the inner surface 32 of the glass tube at a portion present along the length L of the spiral portion 25 is lower than a predetermined temperature. Here, surface temperature of the heater wire 23 rises with an increase in a heating value per unit area, which corresponds to Joule heat, with respect to surface area of the glass tube inner surface 32. When the heating value per unit area becomes not lower than a predetermined value, temperature becomes not lower than an ignition temperature of a flammable coolant to be used. That is, if the glass tube 22 is not designed in such a manner that an area of the inner surface 32 is not provided which is suitable to a heating value of the heater wire 23, quantity of heat radiated to an exterior from the heater wire 23 through the glass tube 22 is decreased, and defrosting capability is lowered while a heated temperature of the heater wire 23 rises.

Then, a heating value per unit area, which corresponds to Joule heat, of the heater wire 23 with respect to the surface area of the glass tube inner surface 32, is set to lower than a predetermined value so that a lowered portion of heat transmission quantity, resulting from a temperature drop, can be compensated with a heat transmission area. While maintaining all of heat radiated from the glass tube 22 on the same level as a conventional level, a temperature of the glass tube 22 associated with the heated temperature of the heater wire 23 can be lowered.

Accordingly, while securing defrosting capability and life to be the same as, or more than, conventional defrosting capability and life, a temperature of the heater wire 23 can be lower than the ignition temperature of the flammable coolant. Even when defrosting is conducted in a case of leakage of the flammable coolant to an atmosphere of the defrosting device 18, danger of ignition can be lowered. Furthermore, when an entire heating value is increased, surface temperature of the heater wire 23 increases. However, even if the entire heating value is increased, a temperature of the heater wire 23 can be lower than the ignition temperature of the flammable coolant irrespective of the entire heating value of the heater wire 23 by designing the nineteenth embodiment in such a manner that a heating value per unit area of the heater wire 23 in its entirety becomes lower than a predetermined value. Thus, design of the defrosting device 18 for setting the flammable coolant to a temperature lower than the ignition temperature of the flammable coolant can be easily made, and an entire heating value can be increased while maintaining a temperature lower than the ignition temperature of the flammable coolant.

(Twentieth Embodiment)

Figure 22:
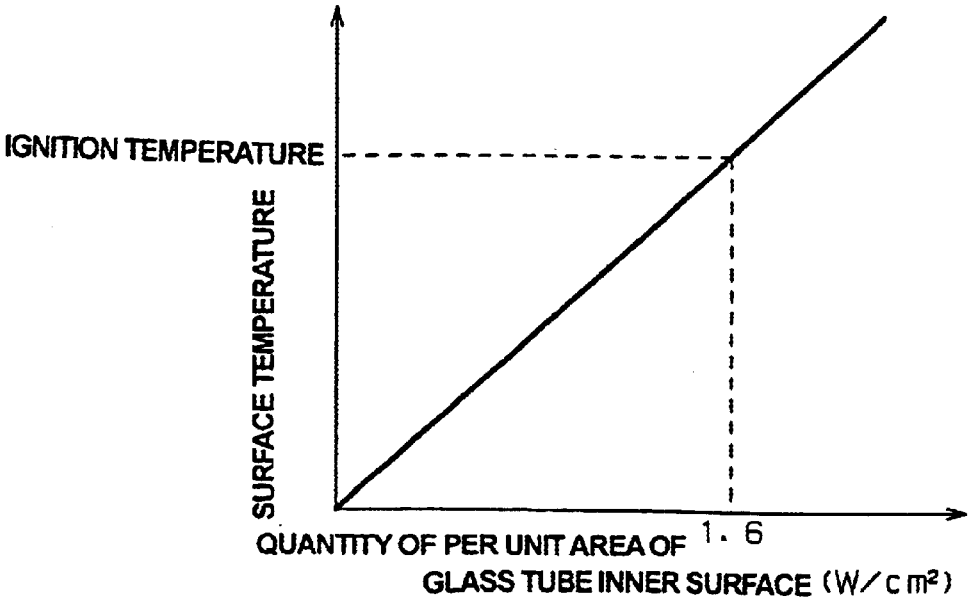
FIG. 22 is a graph corresponding to the twentieth embodiment of the present invention.

With reference to FIGS. 21 and 22, the horizontal axis of FIG. 22 represents a heating value per unit area of a glass tube inner surface, which quantity is obtained by dividing a heating value of Joule heat of heater wire 23 present along length L of spiral portion 25 by surface area of glass tube inner surface 32 corresponding to length L of the spiral portion 25, while the vertical axis of FIG. 22 represents a surface temperature of the heater wire 23. Furthermore, coolant in a freezing cycle is isobutane.

With respect to a freezing refrigerator which is constituted in this manner, an operation thereof will be explained. At a defrosting time, the heater wire 23 is electrified through lead wire 27. At this time, defrosting device 18 defrosts an evaporator (not shown) when Joule heating value per surface area of the glass tube inner surface 32 of the portion present along length L of the spiral portion 25 is lower than 1.6 $W/cm^2$.

Here, surface temperature of the heater wire 23 rises with an increase in a heating value per unit area, which corresponds to Joule heat, with respect to surface area of the glass tube inner surface 32. When the heating value per unit area becomes 1.6 $W/cm^2$, the heating value becomes larger than an ignition temperature of the isobutane. That is, unless the glass tube is not designed so as to have an area of the glass tube inner surface 32 which is appropriate for a heating value of the heater wire 23, quantity of heat radiated to an exterior from the heater wire 23 through the glass tube 22 is lowered, and defrosting capability is lowered while a heated temperature of the heater wire 23 rises.

Therefore, a lowered portion of a heat transmission quantity resulting from a temperature drop of the glass tube can be compensated with a heat transmission area by setting to lower than 1.6 $W/cm^2$ a heating value per unit area, which corresponds to a Joule heat of the heater wire, with respect to surface area of the glass tube inner surface 32. Thus, while maintaining an entire heating value of the glass tube 22 on the same level as, or a higher level than, a conventional level, temperature of the glass tube 22 associated with the heated temperature of the heater wire 23 can be lowered.

Accordingly, a temperature of the heater wire 23 can be lower than the ignition temperature of the isobutane while securing defrosting capability and life to be the same as, or more than, conventional defrosting capability and life. Even when defrosting is conducted in a case of leakage of flammable coolant to an atmosphere of the defrosting device 18, danger of ignition can be lowered. Furthermore, when an entire heating value of the heater wire 23 is increased, surface temperature of the heater wire 23 rises. However, even when the entire heating value is increased, a temperature of the heaterwire 23 can be lower than the ignition temperature of the isobutane irrespective of the entire heating value of the heater wire 23 by designing this embodiment so that a heating value per unit area is lower than 1.6 $W/cm^2$ even when the entire heating value is increased. Consequently, design of the defrosting device 18 for setting a temperature to lower than the ignition temperature of the isobutane can easily be made, and the entire heating value can be increased while maintaining a temperature lower than the ignition temperature of the isobutane.

In the twentieth embodiment, the heated temperature of the heater wire 23 is lower than the ignition temperature of the isobutane. Specifically, in a case where isobutane coolant is used, as the heated temperature of the heater wire 23, it is required to set this temperature to 360° C. or lower in consideration of safety with respect to about 460° C., which is the ignition temperature of isobutane. In this case, a heating value per unit area of the glass tube is 0.67 W/cm$^2$ or lower.

(Twenty-first Embodiment)

Figure 23:
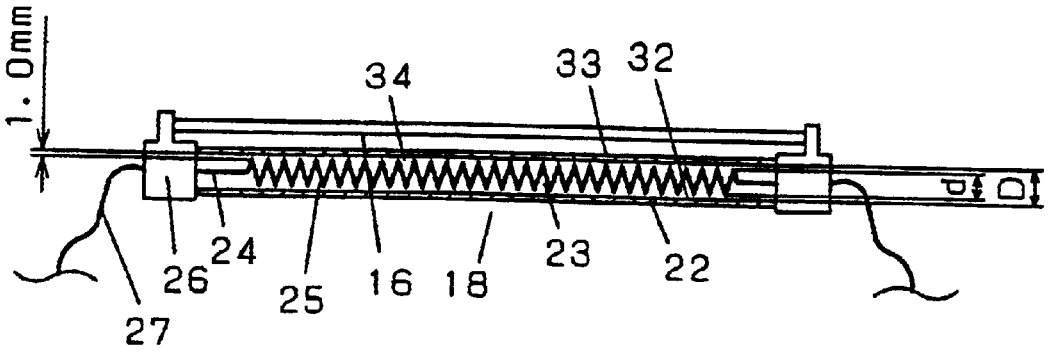
FIGS. 23 through 25 are schematic vertical sectional views showing respective heaters according to twenty-first to twenty-third embodiments of the present invention.

As shown in FIG. 23, reference numeral 34 denotes air, which is gas inside of the glass tube 22. Symbol d denotes an outer diameter of spiral portion 25 of heater wire 23. Symbol D denotes an inner diameter of the glass tube 22. A distance between an outer peripheral portion of the spiral portion of the heater wire 23 and inner surface 32 of the glass tube is 1 mm.

At a defrosting time, heat radiated from a surface of heater wire 23 of defrosting device 18 is radiated to an exterior from an outer surface of the spiral portion 25 of the heater wire 23 through a layer of air having a low transmission rate, which layer is present between the heater wire 23 and the glass tube 22. Then, heat transmission of the glass tube inner surface 32 from the heater wire 23, and heat radiation to the exterior, are promoted by reducing the layer of air having a low transmission rate to 1 mm with a result that heat radiation to the exterior is promoted and defrosting is promoted, while a temperature of a surface of the heater wire 23 is lowered.

Furthermore, work can be easily done at a time of inserting the heater wire 23 into the glass tube 22 during a manufacture step because of an allowance difference of the inner diameter D of the glass tube 22 and an allowance difference of the outer diameter d of the spiral portion 25 of the heater wire 23. Accordingly, a temperature of the heater wire 23 can be lower than an ignition temperature of a flammable coolant to be used while maintaining workability during the manufacture step at the same level as, or a higher level than, conventional workability. Thus, even when defrosting is conducted in a case of leakage of the flammable coolant to an atmosphere of the defrosting device 18, danger of ignition can be lowered. Incidentally, as expressed above in the twenty-first embodiment, a distance between an outer peripheral portion of the spiral portion 25 of the heater wire 23 and the inner surface of the glass tube 22 is 1 mm. However, when this distance is less than 1 mm, the same, or a greater effect can be obtained. Also, as expressed above, the gas in the glass tube is air. However, when heat transmission is unfavorable, the same effect can be obtained.

Additionally, in the twenty first embodiment, a heated temperature of the heater wire 23 is lower than the ignition temperature of the flammable coolant. However, in order to use isobutane as the coolant, and in order to set the heater wire 23 to 360° C. or lower in consideration of a safety rate for prevention of ignition of the flammable coolant, not only is a distance between the outer peripheral portion of the spiral portion 25 of the heater wire 23 and an inner surface 32 of the glass tube 22 1 mm or less, but also a Joule heating value with respect to surface area of the heater wire 23 is 0.67 W/cm$^2$ or lower, and a Joule heating quantity of the heater wire 23 with respect to the surface area of the inner surface of the glass tube is 0.67 W/cm$^2$ or lower, with a result that a heated temperature of the heater wire 23 can be more effectively lowered to 360° C. or lower.

(Twenty-second Embodiment)

Figure 24:
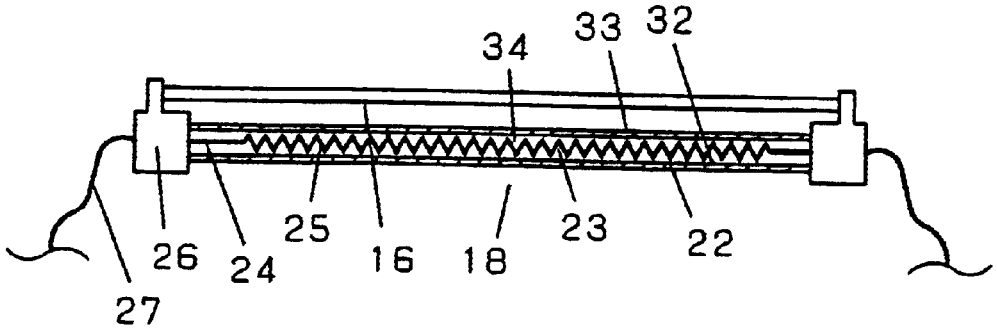

As shown in FIG. 24, spiral portion 25 of heater wire 23 and glass tube inner surface 32 come into contact with each other. In this case, at a defrosting time, heat radiated from the heater wire 23 of defrosting device 18 is partially transmitted to the glass tube 22 through a contact surface with the glass tube inner surface 32, to be radiated to an exterior from glass tube outer surface 33, while remaining heat passes through an interior of the glass tube 22 from the glass tube inner surface 32 through air 34 inside of the glass tube 22, to be radiated from the glass tube outer surface 33. At this time, since the glass tube 22 has an extremely favorable heat transmission rate relative to that of air 34 in the glass tube 22, heat transmission is promoted with contact of the heater wire 23 and the glass tube inner surface 32, so that quantity of heat radiated from the heater wire 23 increases and defrosting is promoted while a heated temperature of the heater wire 23 is lowered.

Accordingly, a temperature of a flammable coolant to be used can be set to lower than an ignition temperature of the flammable coolant, while securing defrosting capability and life to be the same as, or more than, conventional defrosting capability and life. Thus, even if defrosting is conducted, danger of ignition can be further lowered.

(Twenty-third Embodiment)

Figure 25:
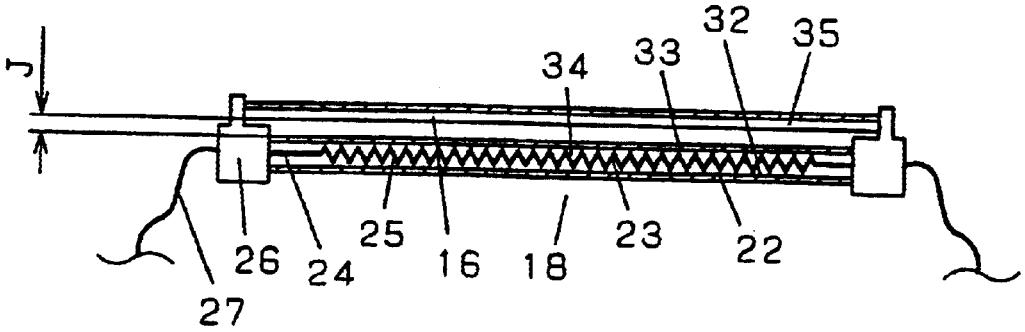
Figure 26:
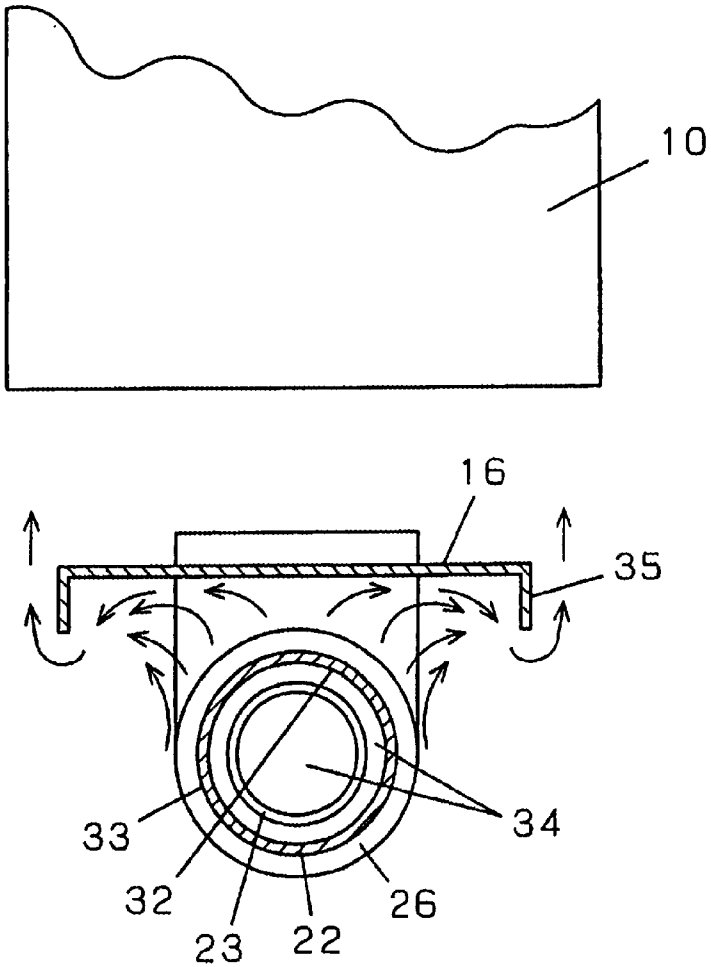
FIG. 26 is a schematic sectional view showing the heater according to the twenty-third embodiment of the present invention.

As shown in FIGS. 25 and 26, defrosting device 18 is provided with a roof 16 above glass tube 22 in which heater wire 23 is mounted. The roof 16 has a square dent-like configuration, and fringes on both sides thereof are denoted by reference numeral 35. The roof 16 is mounted in such a manner that an open portion of the configuration thereof is located below. Furthermore, symbol J denotes a predetermined value of a size of a minimum distance portion between the roof 16 and glass tube outer surface 33. An arrow denotes a passage of convection air. In a freezing refrigerator using this defrosting device 18, at a defrosting time, the glass tube outer surface 33 is heated with heating of the heater wire 23 so that heat is transmitted to peripheral air and a temperature rises and air moves in an upward direction by convection. Then, air fills the square dent-like configuration, and an overflow of the air moves above the roof 16 from the fringes 35 to defrost an evaporator (not shown) and other peripheral parts. Water which is liquefied through defrosting is dripped on an upper portion of the roof 16 and is dripped below the defrosting device without dripping on the glass tube via the fringes of the square dent-like configuration. At this time, since an area above the glass tube 22 is exposed to high temperature air in the square dent-like configuration, temperature rises, and an upper part of the heater wire 23 also rises in temperature. Since there is no part where high temperature air filled in the dent-like configuration of the roof 16 comes into contact with the glass tube 22, by providing a distance of a predetermined value J or more between the roof 16 and the glass tube 22, temperature of the glass tube 22 is lowered along with a heated temperature of the heater wire 23.

Accordingly, a temperature of the heater wire 23 can be lower than an ignition temperature of a flammable coolant to be used. Consequently, even when defrosting is conducted in a case of leakage of the flammable coolant to an atmosphere of the defrosting device 18, danger of ignition can be lowered.

(Twenty-fourth Embodiment)

Figure 27:
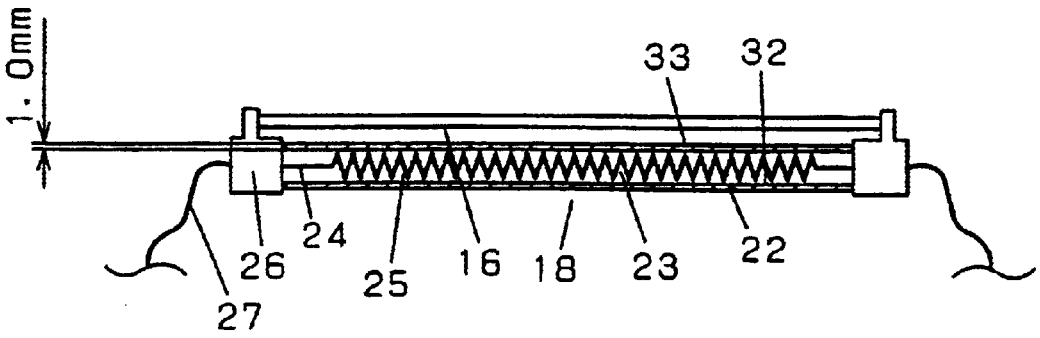
FIG. 27 is a schematic vertical sectional view showing a heater according to a twenty-fourth embodiment and a twenty-fifth embodiment of the present invention.

As shown in FIG. 27, in the twenty fourth embodiment, thickness of glass tube 22 is 1.0 mm. When thickness of the glass tube is set in this manner, at a defrosting time, heat radiated from heater wire 23 is radiated to an exterior from glass tube outer surface 33, via thickness of the glass tube 22, from glass tube inner surface 32 to defrost peripheral parts. At this time, since thickness of the glass tube 22 is 1.0 mm, quantity of heat radiated through the glass tube 22 from the heater wire 23 by promotion of heat transmission of the glass tube 22 increases while maintaining strength of the glass tube 22. Consequently, defrosting is promoted while a heated temperature of the heater wire 23 is lowered.

Accordingly, while securing defrosting capability and life to be the same as, or more than, conventional defrosting capability and life, a temperature of the heater wire 23 can be not lower than an ignition temperature of a flammable coolant to be used. Consequently, even when defrosting is conducted in a case of leakage of the flammable coolant to an atmosphere of defrosting device 18, danger of ignition can be further lowered.

Incidentally, in the twenty fourth embodiment, though the thickness of the glass tube 22 is 1.0 mm, when the thickness is 1.5 mm or less, a defrosting degree is different, but the same effect can be obtained.

(Twenty-fifth Embodiment)

As shown in FIG. 27, in the twenty fifth embodiment, quartz is used as a material for glass tube 22. When a defrosting device using such a quartz glass tube is used, the following advantage can be provided.

As is widely known, before and after defrosting, a coolant is allowed to flow to an evaporator for cooling a freezing chamber and refrigerator chamber of a refrigerator housing. Then, the glass tube in the defrosting device located on a periphery of the evaporator comes to have a negative temperature. Then, at a defrosting time, a heater wire is heated with operation of the defrosting device so that the heater wire is heated and reaches a high temperature in a short time. A temperature of the glass tube changes from 300 to 450° C. in a short time. At this time, it sometimes happens that conventional glass is damaged because of a difference in linear swelling. There is a danger in that a flammable coolant being used catches fire when defrosting is conducted in a case where the flammable coolant is leaked to an atmosphere of the defrosting device in a damaged state.

However, quartz glass is not damaged because linear swelling owing to temperature change is small. Consequently, when defrosting is conducted in a case of leakage of a flammable coolant to an atmosphere of a defrosting device, danger of ignition can be further lowered.

(Twenty-sixth Embodiment)

Figure 29:
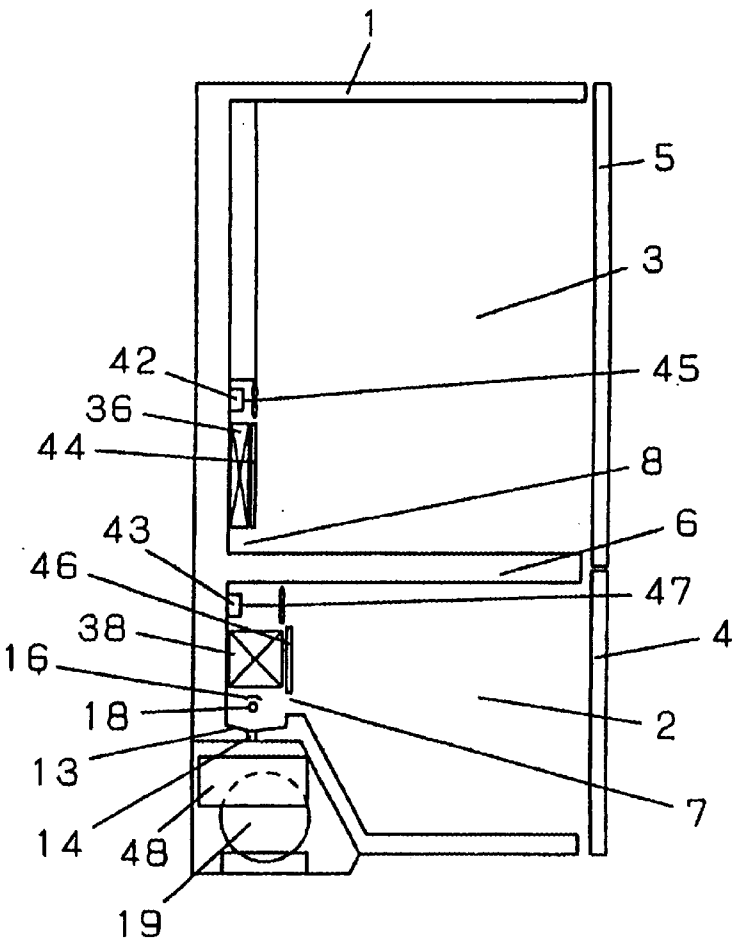
FIG. 29 is a schematic vertical sectional view showing a refrigerator according to the twenty-sixth embodiment of the present invention.
Figure 28:
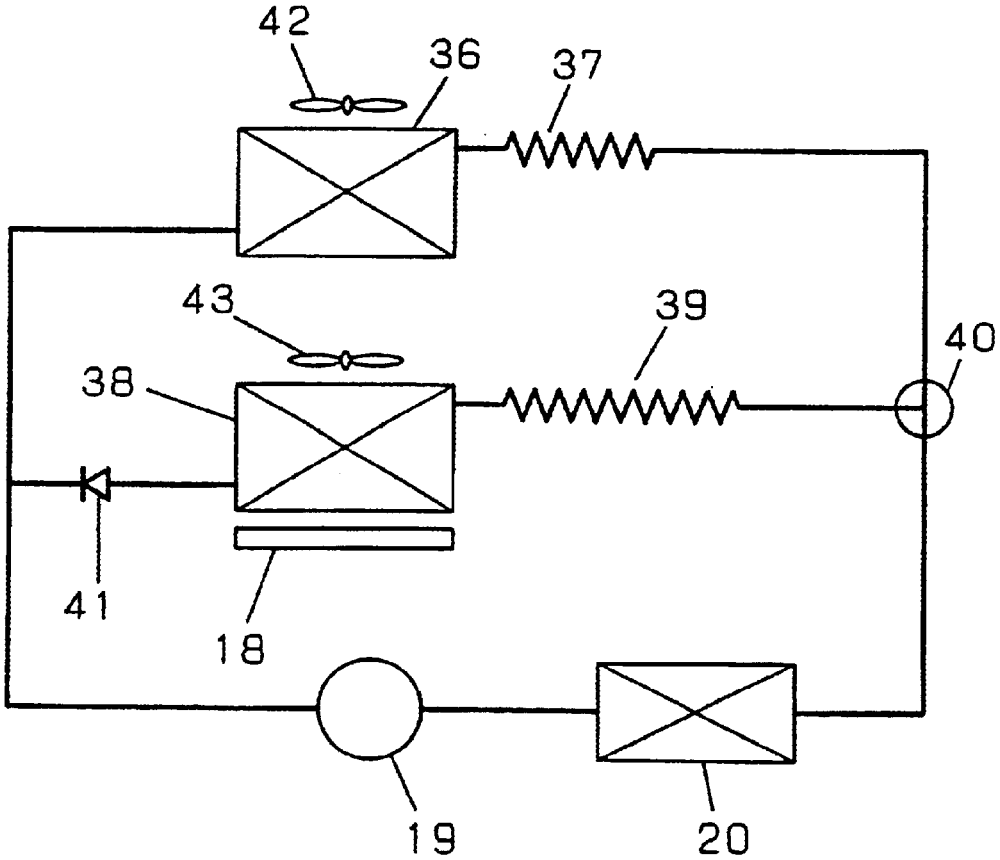
FIG. 28 is a schematic view showing a freezing refrigerator according to a twenty-sixth embodiment of the present invention.

As shown in FIGS. 28 and 29, reference numeral 36 denotes a cooling device for a refrigerator chamber which has a high evaporation temperature. Reference numeral 37 denotes a depression mechanism for a high evaporation temperature which has a small depression quantity for a high evaporation temperature. Reference numeral 38 denotes a cooling device for a freezing chamber which has a low evaporation temperature. Reference numeral 39 denotes a depression mechanism for low evaporation temperature having a large depression quantity for a low evaporation temperature. Reference numeral 40 denotes a change-over valve for changing over a flow channel of a coolant. Reference numeral 41 denotes a check valve for preventing a reverse current of the coolant to the cooling device 38 from the cooling device 36.

Reference numeral 42 denotes a refrigerator fan for allowing air in refrigerator chamber 3 to pass through the cooling device 36 for heat exchange, thereby circulating cooling air. Reference numeral 43 denotes a fan for freezing chamber 2 for circulating cooling air by allowing air in the freezing chamber 2 to pass through the cooling device 38 to circulate the cooling air through heat exchange. Reference numeral 44 denotes a partition wall for the cooling device 36, which serves as a duct for smoothly ventilating the cooling device 36 while preventing heat movement from the cooling device 36 to the refrigerator chamber 3. Reference numeral 45 denotes a discharge port for the refrigerator chamber 3 for discharging cool air which is heat exchanged with the cooling device 36 with operation of the fan 42. Reference numeral 46 denotes a partition wall of a cooling device for the freezing chamber 2, which constitutes a duct for smoothly ventilating the cooling device 38. Reference numeral 47 denotes a discharge port of the freezing chamber 2 for discharging to the freezing chamber cool air which is heat exchanged with the cooling device 38 with operation of the fan 43. Reference numeral 48 denotes an evaporation detaining defrost water which is generated when the cooling device 38 is heat exchanged for automatic evaporation.

With respect to a refrigerator which is constituted in this manner, operation thereof will be explained. In a case of cooling the refrigerator chamber 3, a freezing cycle for cooling the refrigerator chamber has a process such that when a temperature of the refrigerator chamber 3 is not lower than a certain temperature, a compressor 19 is operated, circulation of a flammable coolant (not shown in the cooling cycle) is started so that the flammable coolant is compressed with heat exchange with outside air, and the coolant is allowed to flow into the cooling device 36 via the depression mechanism 37 with operation of the change-over valve 40, to be absorbed in the compressor 19.

At this time, air in the refrigerator chamber 3 is absorbed from an inlet port 8 of the refrigerator chamber by operation of the refrigerator fan 42 together with operation of the compressor 19. Then the cooling device 36 is ventilated and heat exchange is conducted, so that cooled air is discharged to the refrigerator chamber 3 from the discharge port 45 to cool the refrigerator chamber. Furthermore, at any time when operation of the compressor 19 is suspended, the fan 42 is operated and air having a temperature exceeding 0° C. is allowed to pass through the cooling device 36. With ventilated air, frost which adheres to the cooling device 36 is defrosted with sublimation, while absolute humidity of the air after passage through the cooling device 36 is increased to be discharged to the refrigerator chamber 3.

In a case of cooling the freezing chamber 2, a cooling cycle for cooling the freezing chamber has a process such that when the freezing chamber 2 is at a temperature not lower than a set temperature, the compressor 19 is operated, circulation of the flammable coolant in the cooling cycle is started, and the flammable coolant is condensed with heat exchange with outside air at a condenser 20 with a result that the coolant is allowed to flow to the cooling device 38 via the depression mechanism 39 with operation of the change-over valve 40, to be absorbed in the compressor 19.

Then, air in the freezing chamber 2 is absorbed from an inlet port 7 of the freezing chamber by operating the fan 43 together with operation of the compressor 19. This air is allowed to pass through the cooling device 38 so that air cooled with heat exchange is discharged from the discharge port 47 to the freezing chamber 2 to cool the freezing chamber. At this time, since air passing through the cooling device 38 is air only in the freezing chamber 2, the cooling device 38 is small in size, and a heat exchange area is small, so that a frost area becomes small and frost quantity decreases.

Furthermore, at any time when operation of the compressor 19 is suspended, or the refrigerator is cooled, a defrosting device 18 is operated to defrost the cooling device 38 and peripheral parts. At this time, coolant in piping of the cooling device 38 is also heated. Then, this heated coolant is evaporated in the piping of the cooling device 38 and moves to a low temperature portion, which is a portion that is not yet heated with the defrosting device 18, to remove frost from a heated portion.

Then, the frost is melted, and the coolant is condensed by removing heat. At this time, part of the coolant which is condensed is partially detained in the cooling device 38 to be heated again with the defrosting device 18. This operation is repeated so that the cooling device 38 in its entirety is defrosted, and defrost water obtained through defrosting is dripped on a basin 13 and is dripped from a drain outlet 14 to an evaporation plate 48 to be detained. The defrost water detained in the evaporation plate 48 is heated at a time of operation of the compressor 19 to be naturally evaporated. In this manner, since the cooling device 38 cools only the freezing chamber 2, a defrost quantity is small. Consequently, a heating value of the defrosting device 18 can be decreased, and a heated temperature of the defrosting device 18 is lowered with a decrease in a heating quantity.

Furthermore, in a conventional cooling device, since a majority of coolant in a cooling cycle is present in an evaporator, which is a cooling device, a large heating value is required for heating by a defrosting device at a defrosting time, so that a large quantity of heat of the coolant is required except for a quantity of heat used for defrosting. However, in the present invention, since a part of coolant is present in the cooling device 36, a quantity of coolant in the cooling device 38 becomes very small as compared with a case of the conventional cooling device. Since a quantity of heat used in heating by the defrosting device, except for defrosting, at a defrosting time may be small, energy can be saved.

Accordingly, a temperature of the defrosting device can be lower than an ignition temperature of a flammable coolant to be used, while maintaining defrosting capability and life to be the same as, or more than, conventional defrosting capability and life. Even in a case where defrosting is conducted in an environment of leakage of the flammable coolant to an atmosphere in which the defrosting device 18 is mounted, danger of ignition of the flammable coolant can be further lowered.

(Twenty-seventh Embodiment)

Figure 30:
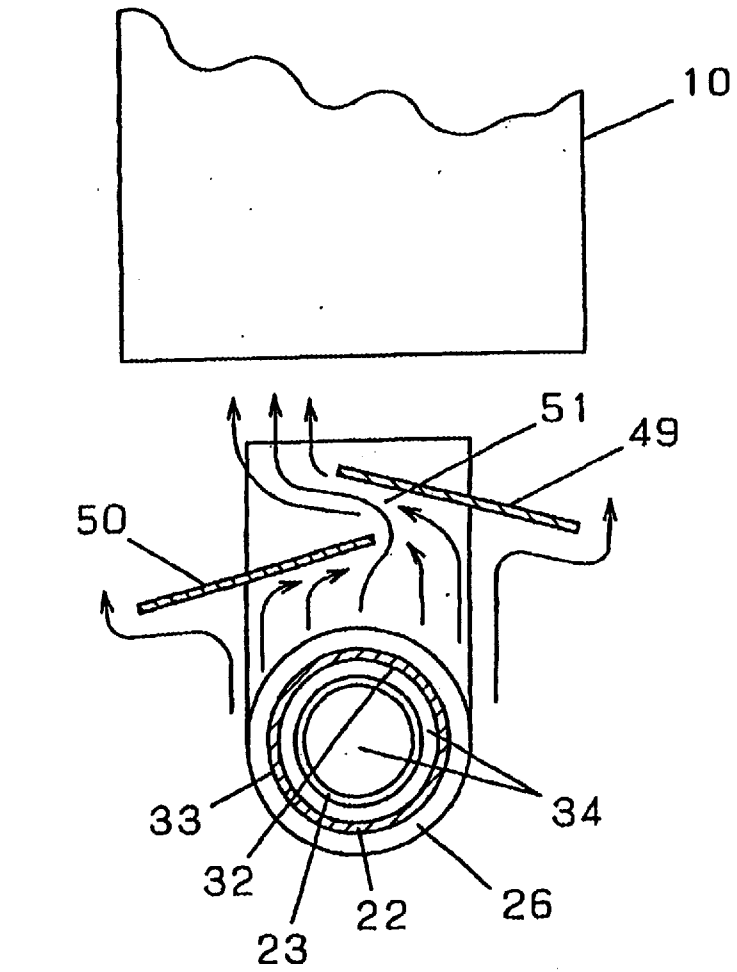
FIG. 30 is a schematic vertical sectional view showing a portion of a defrosting device according to a twenty-seventh embodiment of the present invention.

As shown in FIG. 30, reference numeral 49 denotes an upper portion inclined plate which is inclined toward the right in a downward direction from above glass tube 22 and constitutes one roof. Reference numeral 50 denotes a lower portion inclined plate which is inclined to the left in a downward direction from above the glass tube 22 and constitutes another roof. Plate 50 is located below the upper portion inclined plate 49. Reference numeral 51 denotes a slit between the upper portion inclined plate 49 and the lower portion inclined plate 50. Furthermore, an arrow denotes a passage of peripheral air of a defrosting device.

With such a constitution, at a defrosting time, heater wire 23 of the defrosting device is heated while the glass tube 22, which is located on the heater wire 23, and an outer periphery of the heater wire 23 comes to have a higher temperature. Then, air in the vicinity of the glass tube 22 is heated and rises to the upper portion inclined plate 49 and the lower portion inclined plate 50 as shown by an arrow. A portion of this air moves to an upper evaporator 10 through the slit 51 and defrosting is conducted through heat exchange with frost which adheres to the evaporator 10 and a periphery thereof. Then, defrost water is dripped to the upper portion inclined plate 49 and the lower portion inclined plate 50, and falls through the upper portion inclined plate 49 and the lower portion inclined plate 50 without being directly dripped on the glass tube 22.

Accordingly, since the defrost water is not directly dripped on the glass tube 22 of the defrosting device as in the prior art, air heated with the defrosting device, with respect to a roof having no conventional slit 51, can be smoothly moved to the evaporator 10 while securing life to be the same as conventional life. As a consequence, a quantity of heat radiated to an exterior further increases, and a defrosting capability is further improved, while a quantity of heat used for a rise in a heated temperature of the heater wire 23 of the defrosting device decreases for an increased portion of a quantity of heat radiated to the exterior with a result that a surface temperature of the heater wire 23 is lowered and the surface temperature can be lower than an ignition temperature of a flammable coolant to be used.

What is claimed is:

1. A refrigerator comprising:

a refrigerator housing having therein a freezing chamber and a refrigerator chamber, said freezing chamber and said refrigerator chamber being arranged such that convection of air between said freezing chamber and said refrigerator chamber is prevented;

a cooling system for functionally connecting (i) a compressor, (ii) a condenser, (iii) a refrigerator chamber cooling device which exhibits a high evaporation temperature for refrigeration, (iv) a first depression mechanism for a high evaporation temperature, said first depression mechanism exhibiting a small depression for a high evaporation temperature, (v) a freezing chamber cooling device which exhibits a low evaporation temperature for freezing, said freezing chamber cooling device being connected in parallel with said refrigerator chamber cooling device, (vi) a second depression mechanism for a low evaporation temperature, said second depression mechanism exhibiting a large depression for a low evaporation temperature, (vii) a change-over valve for preventing simultaneous flow of a flammable coolant to said refrigerator chamber cooling device and said freezing chamber cooling device, and (viii) a check valve for preventing a reverse flow of the flammable coolant to an outlet of said freezing chamber cooling device so as to seal the flammable coolant;

a defrosting heater for defrosting said freezing chamber cooling device while said compressor is not operating or while said refrigerator chamber is cooled;

a refrigerator chamber fan for being operated during operation of said compressor so as to cool said refrigerator chamber, and for being operated while said compressor is not operating so as to defrost said refrigerator chamber cooling device via ventilated air; and a freezing chamber fan for being operated, simultaneously with cooling of said refrigerator chamber by said refrigerator chamber fan, during operation of said compressor so as to cool said freezing chamber.

2. The refrigerator according to claim 1, wherein said defrosting heater includes a metal resistor heater wire in a quartz glass tube, with said metal resistor heater wire having a spiral portion.

3. The refrigerator according to claim 2, wherein said metal resistor heater wire has a heating value per unit area that is less than 2.5 W/cm$^2$, with said heating value per unit area being obtained by dividing a heating value, with Joule heat, of said spiral portion by a surface area of said spiral portion.

4. The refrigerator according to claim 2, wherein said metal resistor heater wire has a value that is less than 8.5 W/cm$^3$, with said value being obtained by dividing a heating value of said spiral portion by a volume defined by an outer diameter and length of said spiral portion.

5. The refrigerator according to claim 2, wherein a value that is less than 9.2 W/cm$^2$ is provided, with said value being obtained by subtracting a heating value per unit area of said spiral portion from a coefficient that is obtained by dividing a pitch of said spiral portion by an outer diameter of said spiral portion.

6. The refrigerator according to claim 2, wherein a pitch of said spiral portion is at least 2 mm.

7. The refrigerator according to claim 2, wherein a portion of said metal resistor heaterwire includes a metal that melts at a temperature lower than an ignition temperature of the flammable coolant.

8. The refrigerator according to claim 2, further comprising a temperature fuse of a metal that melts at a temperature lower than an ignition temperature of the flammable coolant, said temperature fuse being wired in series with said defrosting heater such that said temperature fuse is near said defrosting heater.

9. The refrigerator according to claim 8, wherein said temperature fuse is mounted on, and in close contact with, a surface of an outer hull of said quartz glass tube.

10. The refrigerator according to claim 9, wherein said temperature fuse is mounted on an upper portion of said quartz glass tube.

11. The refrigerator according to claim 9, wherein said temperature fuse is mounted on a lower portion of said quartz glass tube.

12. The refrigerator according to claim 9, wherein said temperature fuse is mounted at an intermediate portion along a length of said quartz glass tube.

13. The refrigerator according to claim 8, wherein said metal of said temperature fuse is a metal that melts at a temperature which is 100° C. to 200° C. lower than the ignition temperature of the flammable coolant.

14. The refrigerator according to claim 2, further comprising a temperature fuse of a metal that melts at a temperature not lower than an ignition temperature of the flammable coolant, said temperature fuse being wired in series with said metal resistor heater wire, wherein said metal resistor heater wire further has a straight portion, and said temperature fuse is mounted on a surface of said quartz glass tube surrounding an outer periphery of said straight portion.

15. The refrigerator according to claim 2, further comprising a temperature detection device for detecting a temperature that is not less than a predetermined temperature, wherein an input to said metal resistor heater wire is to be shielded when said temperature detection device detects a temperature that is not less than the predetermined temperature, wherein said metal resistor heater wire further has straight portions at both ends of said metal resistor heater wire, respectively, said spiral portion is between said straight portions, and said temperature detection device is on a surface of said quartz glass tube surrounding an outer periphery of one of said straight portions.

16. The refrigerator according to claim 15, wherein said temperature detection device is for detecting a temperature that is 310° C. to 410° C. lower than an ignition temperature of the flammable coolant.

17. The refrigerator according to claim 2, wherein a heating value per unit area, obtained by dividing a heating value of Joule heat of said spiral portion by a surface area of an inside surface of said quartz glass tube, is less than 1.6 W/cm$^2$.

18. The refrigerator according to claim 2, wherein a clearance between an inside surface of said quartz glass tube and said metal resistor heater wire is at most 1 mm.

19. The refrigerator according to claim 2, wherein said metal resistor heater wire and an inner surface of said quartz glass tube are in contact with one another.

20. The refrigerator according to claim 2, wherein a wall thickness of said quartz glass tube is at most 1.5 mm.

21. The refrigerator according to claim 2, wherein said defrosting heater further includes a roof above said quartz glass tube, said roof comprising two plates inclined in opposite directions with respect to one another.

22. The refrigerator according to claim 1, wherein said defrosting heater includes a heater wire in a glass tube, with said heater wire having a spiral portion.

23. The refrigerator according to claim 22, wherein said heater wire has a heating value per unit area that is less than 2.5 W/cm$^2$, with said heating value per unit area being obtained by dividing a heating value, with Joule heat, of said spiral portion by a surface area of said spiral portion.

24. The refrigerator according to claim 22, wherein said heater wire has a value that is less than 8.5 W/cm$^3$, with said value being obtained by dividing a heating value of said spiral portion by a volume defined by an outer diameter and length of said spiral portion.

25. The refrigerator according to claim 22, wherein a value that is less than 9.2 W/cm$^2$ is provided, with said value being obtained by subtracting a heating value per unit area of said spiral portion from a coefficient that is obtained by dividing a pitch of said spiral portion by an outer diameter of said spiral portion.

26. The refrigerator according to claim 22, wherein a pitch of said spiral portion is at least 2 mm.

27. The refrigerator according to claim 22, wherein a portion of said heater wire includes a metal that melts at a temperature lower than an ignition temperature of the flammable coolant.

28. The refrigerator according to claim 22, further comprising a temperature fuse of a metal that melts at a temperature lower than an ignition temperature of the flammable coolant, said temperature fuse being wired in series with said defrosting heater such that said temperature fuse is near said defrosting heater.

29. The refrigerator according to claim 28, wherein said temperature fuse is mounted on, and in close contact with, a surface of an outer hull of said glass tube.

30. The refrigerator according to claim 29, wherein said temperature fuse is mounted on an upper portion of said glass tube.

31. The refrigerator according to claim 29, wherein said temperature fuse is mounted on a lower portion of said glass tube.

32. The refrigerator according to claim 29, wherein said temperature fuse is mounted at an intermediate portion along a length of said glass tube.

33. The refrigerator according to claim 28, wherein said metal of said temperature fuse is a metal that melts at a temperature which is 100° C. to 200° C. lower than the ignition temperature of the flammable coolant.

34. The refrigerator according to claim 22, further comprising a temperature fuse of a metal that melts at a temperature not lower than an ignition temperature of the flammable coolant, said temperature fuse being wired in series with said heater wire, wherein said heater wire further has a straight portion, and said temperature fuse is mounted on a surface of said glass tube surrounding an outer periphery of said straight portion.

35. The refrigerator according to claim 22, further comprising a temperature detection device for detecting a temperature that is not less than a predetermined temperature, wherein an input to said heater wire is to be shielded when said temperature detection device detects a temperature that is not less than the predetermined temperature, wherein said heater wire further has a straight portion, and said temperature detection device is on a surface of said glass tube surrounding an outer periphery of said straight portion.

36. The refrigerator according to claim 35, wherein said temperature detection device is for detecting a temperature that is 310° C. to 410° C. lower than an ignition temperature of the flammable coolant.

37. The refrigerator according to claim 22, wherein a heating value per unit area, obtained by dividing a heating value of Joule heat of said spiral portion by a surface area of an inside surface of said glass tube, is less than 1.6 $W/cm^2$.

38. The refrigerator according to claim 22, wherein a clearance between an inside surface of said glass tube and said heater wire is at most 1 mm.

39. The refrigerator according to claim 22, wherein said heater wire and an inner surface of said glass tube are in contact with one another.

40. The refrigerator according to claim 22, wherein a wall thickness of said glass tube is at most 1.5 mm.

41. The refrigerator according to claim 22, wherein said defrosting heater further includes a roof above said glass tube, said roof comprising two plates inclined in opposite directions with respect to one another.

* * * * *